US008029088B2

(12) United States Patent
Hosokawa et al.

(10) Patent No.: US 8,029,088 B2
(45) Date of Patent: Oct. 4, 2011

(54) LIQUID EJECTING APPARATUS AND EJECTION INSPECTING METHOD

(75) Inventors: Yasuhiro Hosokawa, Shiojiri (JP); Seiji Izuo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/555,779

(22) Filed: Sep. 8, 2009

(65) Prior Publication Data

US 2010/0060690 A1 Mar. 11, 2010

(30) Foreign Application Priority Data

Sep. 9, 2008 (JP) ..... 2008-231260

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 6,951,379 B2 * 10/2005 Sarmast et al. ..... 347/19
2009/0278874 A1 * 11/2009 Motoyama et al. ..... 347/9

FOREIGN PATENT DOCUMENTS

JP 2007-152888 A 6/2007
JP 2008-080695 A 4/2008

* cited by examiner

*Primary Examiner* — Julian Huffman
(74) *Attorney, Agent, or Firm* — Kilpatrick Townsend & Stockton LLP

(57) ABSTRACT

A liquid ejecting apparatus includes: a head which ejects a liquid from nozzles; a first electrode which charges the liquid with a first potential; a second electrode which is charged with a second potential different from the first potential; and an inspector which inspects whether the liquid is ejected from the nozzles based on a variation in a potential caused in at least one of the first and second electrodes by ejecting the liquid charged with the first potential from the nozzles to the second electrode and which determines whether the inspection of liquid ejection from the nozzles is normally executed based on the variation in the potential during a non-ejection period in which the liquid is not ejected from all of the nozzles.

7 Claims, 17 Drawing Sheets

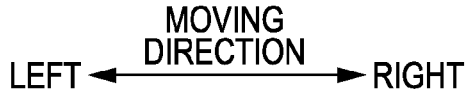
FIG. 3A
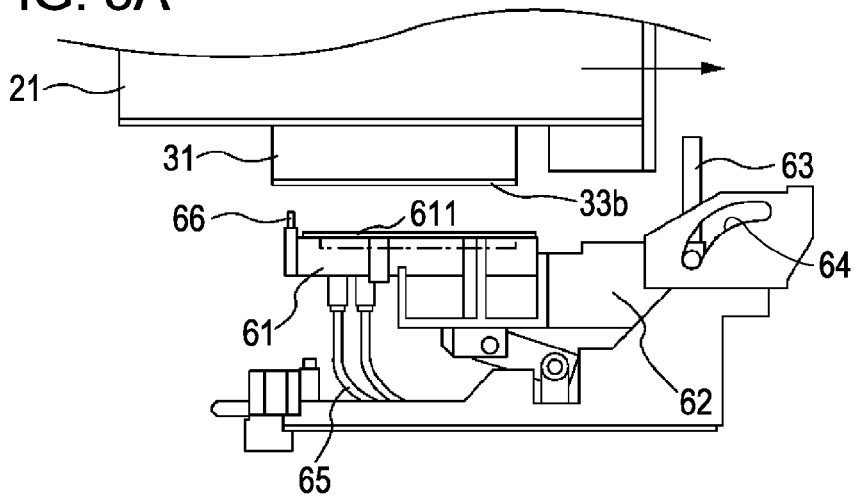
FIG. 3B
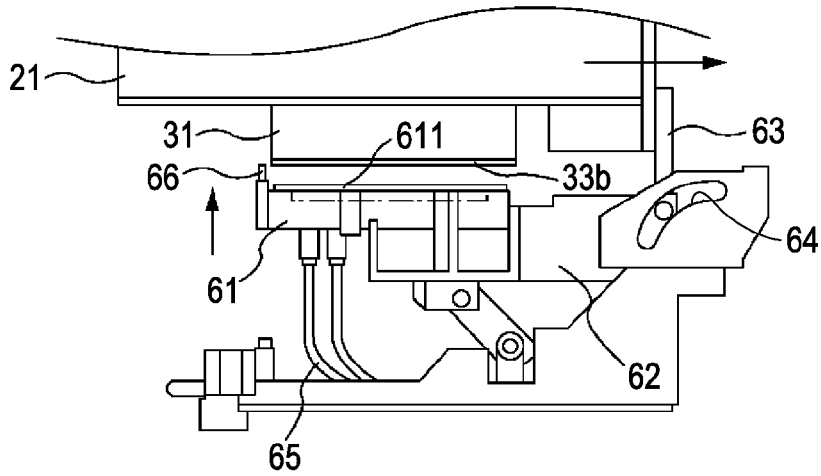
FIG. 3C
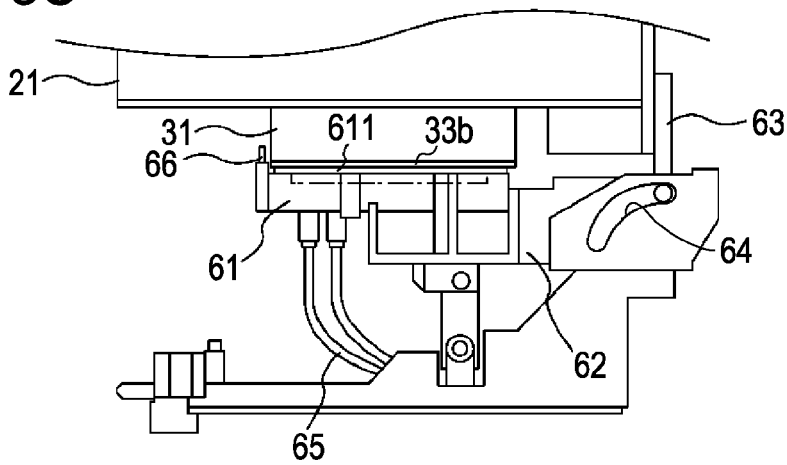

FIG. 9C

| | FIRST UNIT BLOCK | SECOND UNIT BLOCK | THIRD UNIT BLOCK |
|---|---|---|---|
| NUMBER OF NOZZLES (PIECE) | 45 | 15 | 4 |
| NUMBER OF NON-EJECTION DUMMY PERIODS (PIECE) | 4 | 12 | 45 |
| UNIT BLOCK INSPECTION PERIOD (ms) | 223.61 | 77.78 | 24.31 |
| TOTAL INSPECTION PERIOD WITHOUT DISTURBANCE (s) | 6.00 | 6.50 | 9.20 |
| TOTAL INSPECTION PERIOD WITH DISTURBANCE (s) | 6.47 | 6.85 | 9.62 |
| NUMBER OF REINSPECTIONS WITHOUT DISTURBANCE (TIMES) | 4 | 7 | 21 |
| WRONG DETECTION RATE (%) | 3.76 | 2.99 | 0.94 |

0.5 s 0.38 s

LIQUID EJECTING APPARATUS AND EJECTION INSPECTING METHOD

This application claims priority to Japanese Patent Application No. 2008-231260, filed Sep. 9, 2009, the entirety of which is incorporated by reference herein.

BACKGROUND

1. Technical Field

The present invention relates to a liquid ejecting apparatus and an ejection inspecting method.

2. Related Art

A liquid ejecting apparatus such as an ink jet printer which ejects charged ink toward a detecting electrode and inspects liquid ejection based on an electric variation occurring in the detecting electrode has been suggested (see JP-A-2007-152888).

When a noise occurs during the ejection inspection upon executing the ejection inspection based on the electric variation, a failure nozzle (a dot missing nozzle) which fails to eject a liquid cannot be exactly detected.

SUMMARY

An advantage of some aspects of the invention is that it provides a liquid ejecting apparatus and a liquid inspecting method of exactly executing ejection inspection.

According to an aspect of the invention, there is provided a liquid ejecting apparatus including: a head which ejects a liquid from nozzles; a first electrode which charges the liquid with a first potential; a second electrode which is charged with a second potential different from the first potential; and an inspector which inspects whether the liquid is ejected from the nozzles based on a variation in a potential caused in at least one of the first and second electrodes by ejecting the liquid charged with the first potential from the nozzles to the second electrode and which determines whether the inspection of liquid ejection from the nozzles is normally executed based on the variation in the potential during a non-ejection period in which the liquid is not ejected from all of the nozzles.

Other aspects of the invention are apparent from the specification and the description of the accompanying drawings.

BRIEF DESCRIPTION OF THE DRAWINGS

The invention will be described with reference to the accompanying drawings, wherein like numbers reference like elements.

FIGS. 3A to 3C are diagrams illustrating a positional relation between a head and a capping mechanism in a recovery operation.

FIG. 9C is a table for summarizing the result of a nozzle number determination test.

DESCRIPTION OF EXEMPLARY EMBODIMENTS

Overview

Figure 1A:
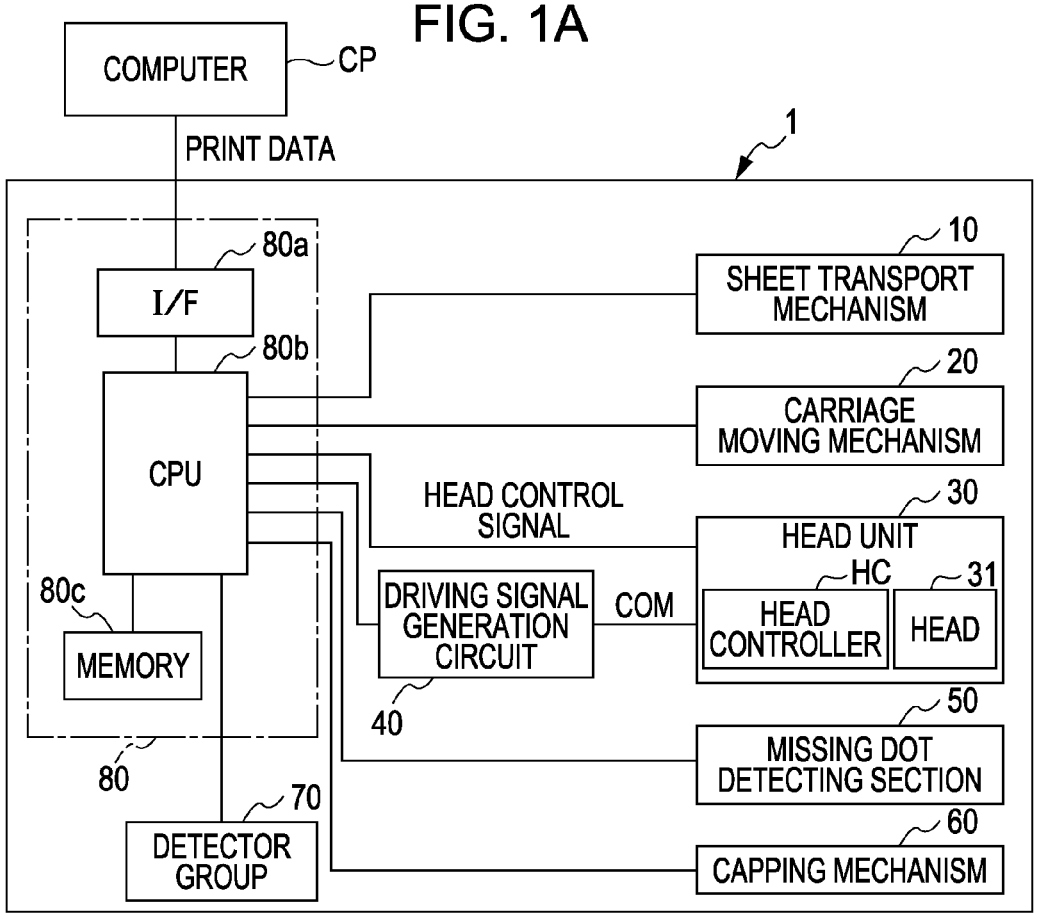
FIG. 1A is a block diagram illustrating a printing system.

The following aspects of the invention are at least apparent from the description of the specification and the description of the accompanying drawings.

According to an aspect of the invention, there is provided a liquid ejecting apparatus including: a head which ejects a liquid from nozzles; a first electrode which charges the liquid with a first potential; a second electrode which is charged with a second potential different from the first potential; and an inspector which inspects whether the liquid is ejected from the nozzles based on a variation in a potential caused in at least one of the first and second electrodes by ejecting the liquid charged with the first potential from the nozzles to the second electrode and which determines whether the inspection of liquid ejection from the nozzles is normally executed based on the variation in the potential during a non-ejection period in which the liquid is not ejected from all of the nozzles.

According to the liquid ejecting apparatus, since a noise occurring in an inspection period can be detected, it is possible to more exactly detect the nozzle which fails to eject the liquid.

In the liquid ejecting apparatus, the inspector may inspect whether the liquid is ejected from the nozzles in every block to which at least one of the nozzles belongs and may provide the non-ejection period to every block.

According to the liquid ejecting apparatus, it is possible to determine whether the inspection of every block is normally executed.

In the liquid ejecting apparatus, a plurality of the nozzles belongs to the block.

According to the liquid ejecting apparatus, it is possible to prevent an inspection period from becoming longer.

In the liquid ejecting apparatus, the inspector may determine that the inspection of the certain block is not normally executed, when the variation in the potential exceeds a threshold value in the non-ejection period provided in a certain block.

According to the liquid ejecting apparatus, it is possible to determine whether the inspection of every block is normally executed.

In the liquid ejecting apparatus, the inspector may execute the inspection of the block again, when the inspector determines that the inspection of the block is not normally executed.

According to the liquid ejecting apparatus, it is possible to more exactly detect the nozzle which fails to eject the liquid.

In the liquid ejecting apparatus, when the inspection of the block is executed up to the predetermined number of times but the inspection of the block is not normally executed, the inspector may allow the liquid ejecting apparatus to execute a predetermined operation and execute the inspection again after the predetermined operation.

According to the liquid ejecting apparatus, since the long-term noise is removed during the predetermined operation or the predetermined operation is executed to vary the status of the liquid ejecting apparatus, it is, therefore, possible to normally execute the inspection with ease.

In the liquid ejecting apparatus, a period in which it is inspected whether the liquid is ejected from one of the nozzles may be the same as the non-ejection period.

According to the liquid ejecting apparatus, it is possible to easily control the inspection.

According to another aspect of the invention, there is provided an ejection inspecting method including: charging a liquid to be ejected from nozzles with a first potential by a first electrode; ejecting the liquid charged with the first potential from the nozzles to a second electrode charged with a second potential different from the first potential; inspecting whether the liquid is ejected from the nozzles based on a variation in a potential caused in at least one of the first and the second electrodes; and determining whether the inspection of liquid ejection from the nozzles is normally executed based on the variation in the potential during a non-ejection period in which the liquid is not ejected from all of the nozzles.

According to the liquid ejecting method, since the noise occurring in the inspection period can be detected, it is possible to more exactly detect the nozzle which fails to eject the liquid.

Ink Jet Printer

In an embodiment described below, an ink jet printer (hereinafter, also referred to as a printer 1) as an example of a liquid ejecting apparatus will be described.

Figure 1B:
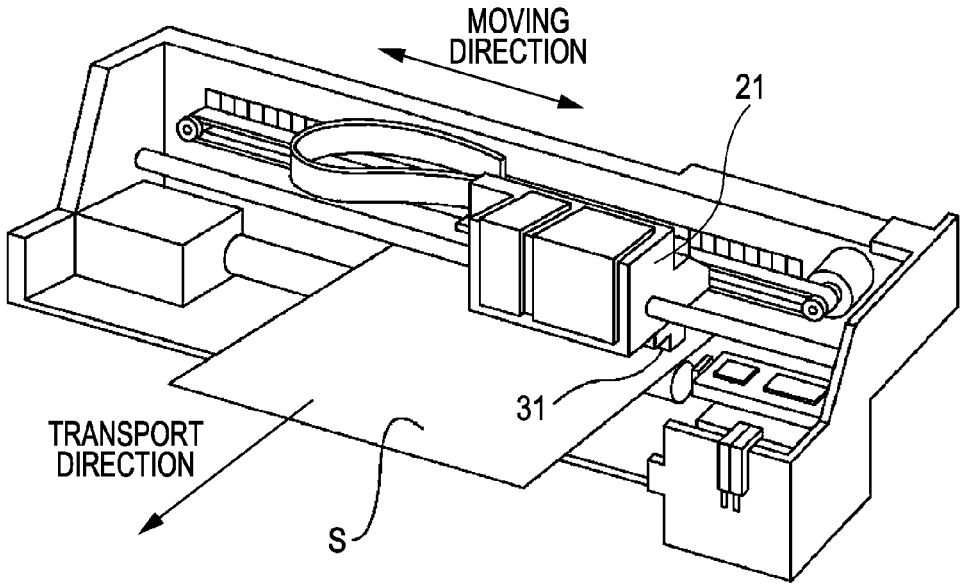
FIG. 1B is a perspective view illustrating a printer.

FIG. 1A is a block diagram illustrating a printing system including a printer 1 and a computer CP. FIG. 1B is a perspective view illustrating the printer 1. The printer 1 ejects ink as an example of a liquid onto a medium such as a sheet, a cloth, or a film. The medium is a target onto which the liquid is ejected. The computer CP is connected to the printer 1 to carry out communication. In order to allow the printer 1 to print an image, the computer CP transmits print data corresponding to the image to the printer 1. The printer 1 includes a sheet transport mechanism 10, a carriage moving mechanism 20, a head unit 30, a driving signal generation circuit 40, a missing dot detecting section 50, a capping mechanism 60, a detector group 70, and a printer controller 80.

The sheet transport mechanism 10 transports a sheet in a transport direction. The carriage moving mechanism 20 moves a carriage 21 mounted on the head unit 30 in a predetermined moving direction (a direction intersecting the transport direction).

The head unit 30 includes a head 31 and a head controller HC. The head 31 ejects ink onto the sheet. The head controller HC controls the head 31 based on a head control signal from a controller 80 of the printer 1.

Figure 2A:
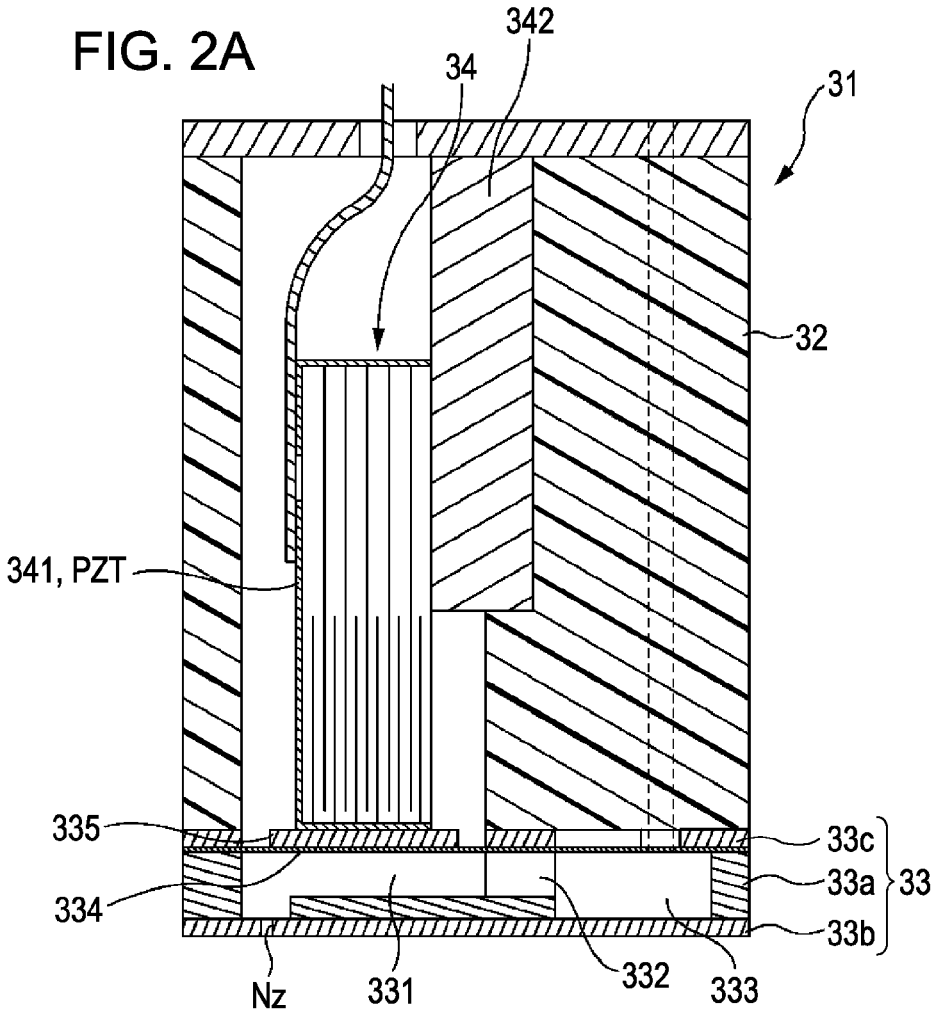
FIG. 2A is a sectional view illustrating a head.

FIG. 2A is a sectional view illustrating the head 31. The head 31 includes a case 32, a passage unit 33, and a piezoelectric element unit 34. The case 32 is a member for accommodating and fixing the piezoelectric element unit 34 and is made of a non-conductive resin material such as epoxy resin.

The passage unit 33 includes a passage forming board 33*a*, a nozzle plate 33*b*, and a vibration plate 33*c*. The nozzle plate 33*b* is joined to one surface of the passage forming board 33*a* and the vibration plate 33*c* is joined to the other surface of the passage forming board 33*a*. Empty spaces or grooves serving as pressure chambers 331, ink supply passages 332, and a common ink chamber 333 are formed in the passage forming board 33*a*. The passage forming board 33*a* is formed of a silicon board, for example. The nozzle plate 33*b* is provided with a nozzle group constituted by plural nozzles Nz. The nozzle plate 33*b* is formed of a plate-shaped member having conductivity, for example, a thin metal plate. The nozzle plate 33*b* is connected to a grand line to be charged with a grand potential. Diaphragms 334 are provided in portions respectively corresponding to the pressure chambers 331 in the vibration plate 33*c*. The diaphragms 334 are deformed by piezoelectric elements PZT to vary the volume of the pressure chambers 331. The piezoelectric elements PZT and the nozzle plate 33*b* are insulated with the vibration plate 33*c*, an adhesive layer, or the like interposed therebetween.

The piezoelectric element unit 34 includes a piezoelectric element group 341 and a fixing plate 342. The piezoelectric element group 341 has a comb teeth shape. Each tooth corresponds to the piezoelectric element PZT. The front end surface of each piezoelectric element PZT is adhered to an island portion 335 included in the diaphragm 334. The fixing plate 342 holds the piezoelectric element group 341 and serves as a portion mounted with the case 32. The piezoelectric element PZT which is a kind of electromechanical conversion element expands and contracts in a longitudinal direction upon applying a driving signal COM to give a pressure variation to the ink in the pressure chambers 331. The ink in the pressure chambers 331 is subjected to the pressure variation by a variation in the volume of the pressure chambers 331. Ink droplets can be ejected from the nozzles Nz by the pressure variation.

Figure 2B:
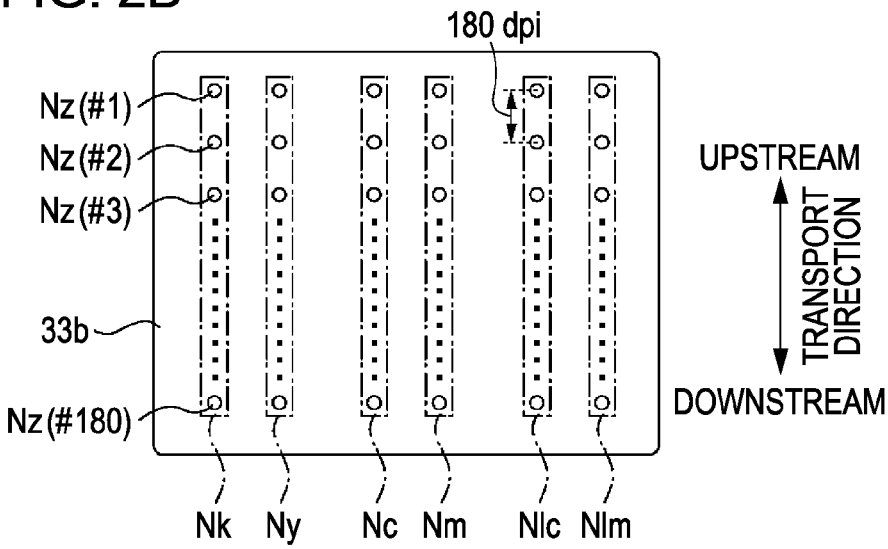
FIG. 2B is a diagram illustrating the arrangement of nozzles.

FIG. 2B is a diagram illustrating the arrangement of the nozzles Nz formed in the nozzle plate 33*b*. Plural nozzle arrays having 180 nozzles at a 180 dpi interval in the transport direction of the sheet are formed in the nozzle plate. The nozzle arrays eject different kinds of ink, respectively. The nozzle plate 33*b* is provided with six nozzle arrays. Specifically, there are provided a black ink nozzle array Nk, a yellow ink nozzle array Ny, a cyan ink nozzle array Nc, a magenta ink nozzle array Nm, a light cyan ink nozzle array Nlc, and a light magenta ink nozzle array Nlm. For easy description, reference numbers (#1 to #180) are given sequentially from the nozzles Nz on the upstream side in the transport direction of the sheet.

The driving signal generation circuit 40 generates the driving signal COM. When the driving signal COM is applied to the piezoelectric elements PZT, the piezoelectric elements PZT expand and contract to vary the volume of the pressure chambers 331 corresponding to the nozzles Nz. Accordingly, the driving signal COM is applied to the head 31 in printing, in a missing-dot inspection operation (described below), or a flushing operation as a recovery operation of dot missing nozzles Nz. The waveform of the driving signal COM is appropriately determined in the printing, the missing-dot inspection operation, and the flushing operation.

The missing dot detecting section 50 detects whether ink is ejected from the nozzles Nz. The capping mechanism 60 executes a sucking operation of sucking ink from the nozzles Nz to prevent an ink solvent from evaporating from the nozzles Nz or recover an ejection capability of the nozzles Nz.

The detector group 70 includes plural detectors for monitoring the status of the printer 1. The detection result obtained by the detectors is output to the printer controller 80.

The printer controller 80 controls the printer 1 as a whole and includes an interface 80*a*, a CPU 80*b*, and a memory 80*c*. The interface 80*a* transmits and receives data to and from the computer CP. The memory 80*c* guarantees an area for storing computer programs, a working area, and the like. The CPU 80*b* controls control targets (the sheet transport mechanism 10, the carriage moving mechanism 20, the head unit 30, the driving signal generation circuit 40, the missing dot detecting section 50, the capping mechanism 60, and the detector group 70) in accordance with the computer programs stored in the memory 80*c*.

The printer 1 forms an image by repeatedly executing a dot forming operation of intermittently ejecting the ink from the head 31 being moved in the moving direction of the carriage to form dots on the sheet and a transport operation of transporting the sheet in the transport direction to form dots at positions different from the positions of the dots formed by the previous dot forming operation.

Dot Missing and Recovery Operation

When the ink (the liquid) is not ejected from the nozzles Nz for a long period of time or foreign substances such as paper dust become attached to the nozzles Nz, the nozzles Nz may become clogged. When the nozzles Nz are clogged, the ink is not ejected at the time of originally ejecting the ink from the nozzles Nz, and thus dot missing occurs. The dot missing refers to a phenomenon that dots are not formed at positions where dots originally should be formed upon ejecting the ink from the nozzles Nz. When the dot missing occurs, an image may deteriorate. In order to solve this problem, in this embodiment, when the missing dot detecting section 50 detects the nozzles Nz (hereinafter, referred to as the dot missing nozzles) missing the dots (described below), the ink is designed to be normally ejected from the dot missing nozzles by executing the recovery operation.

FIGS. 3A to 3C are diagrams illustrating a positional relation between the head 31 and the capping mechanism 60 in the recovery operation. First, the capping mechanism 60 will be described. The capping mechanism 60 includes a cap 61 and a sliding member 62 which holds the cap 61 and is movable in an inclined vertical direction. The cap 61 includes a rectangular bottom (not shown) and a side wall 611 upright from the circumference of the bottom and is formed in a thin box-like shape of which the upper surface facing the nozzle plate 33*b* is opened. A sheet-shaped moisturizing member formed of a porous member such as a felt or a sponge is disposed in a space surrounded by the bottom and the side wall 611.

As shown in FIG. 3A, the cap 61 is positioned at a location sufficiently lower than the surface (hereinafter, referred to as a nozzle surface) of the nozzle plate 33*b* when the carriage 21 is away from a home position (at which the carriage 21 is located in the rightmost side in the moving direction). As shown in FIG. 3B, the carriage 21 comes in contact with a contact section 63 formed in the sliding member 62 and the contact section 63 is moved toward the home position together with the carriage 21, when the carriage 21 is moved to the home position. When the contact section 63 is moved toward the home position, the sliding member 62 moves up along a long guiding hole 64 and the cap 61 also move up along the long guiding hole 64. Finally, when the carriage 21 is located at the home position, as shown in FIG. 3C, the side wall 611 (the porous member) of the cap 61 and the nozzle plate 33*b* closely contact with each other. Accordingly, by locating the carriage 21 at the home position at power-off time or during a long pause, it is possible to prevent the ink solvent from evaporating from the nozzles Nz.

Next, the recovery operation will be described. "The flushing operation" is executed as one of the recovery operations of recovering the dot missing nozzles. As shown in FIG. 3B, the flushing operation refers to an operation of forcibly continuing the ejection of ink droplets from the nozzles Nz in a state where a gap is slightly opened between the nozzle surface and the edge (the upper end of the side wall 611) of the opening of the cap 61.

A waste liquid tube 65 is connected to a space between the bottom surface and the side wall 611 of the cap 61 and a sucking pump (not shown) is connected in the waste liquid tube 65. As another example of the recovery operation, "a pump sucking operation" is executed in a state where the edge of the opening of the cap 61 comes in contact with the nozzle surface, as show in FIG. 3C. When the sucking pump operates in the state where the side wall 611 of the cap 61 closely comes in contact with the nozzle surface, the space of the cap 61 becomes a negative pressurized state. In this way, since the ink in the head 31 can be sucked together with the thickened ink or the paper dust, the dot missing nozzles can be recovered.

As another recovery operation, "a minute vibration operation" is executed. The minute vibration operation refers to an operation of dispersing the thickened ink near the nozzles by giving the pressure variation to the ink in the pressure chambers 331 to the extent that the ink droplets are not ejected, moving a meniscus (a free surface of the ink exposed to the nozzles Nz) toward the ejection side and the lead-in side, and mixing the ink. In addition, the ink droplets or the foreign substances attached onto the nozzle surface can be removed by a wiper 66 protruding further than the side wall 611 of the cap 61 by moving the carriage 21 in the moving direction, while keeping the cap mechanism 60 at the position shown in FIG. 3B.

That is, in the printer 1 according to this embodiment, it is possible to normally eject the ink from the dot missing nozzles by executing recovery operations such as the flushing operation, the pump sucking operation, the minute vibration operation, and the cleaning operation of the nozzle surface by the wiper 66.

Ejection Inspection

Missing Dot Detecting Section 50

Figure 4:
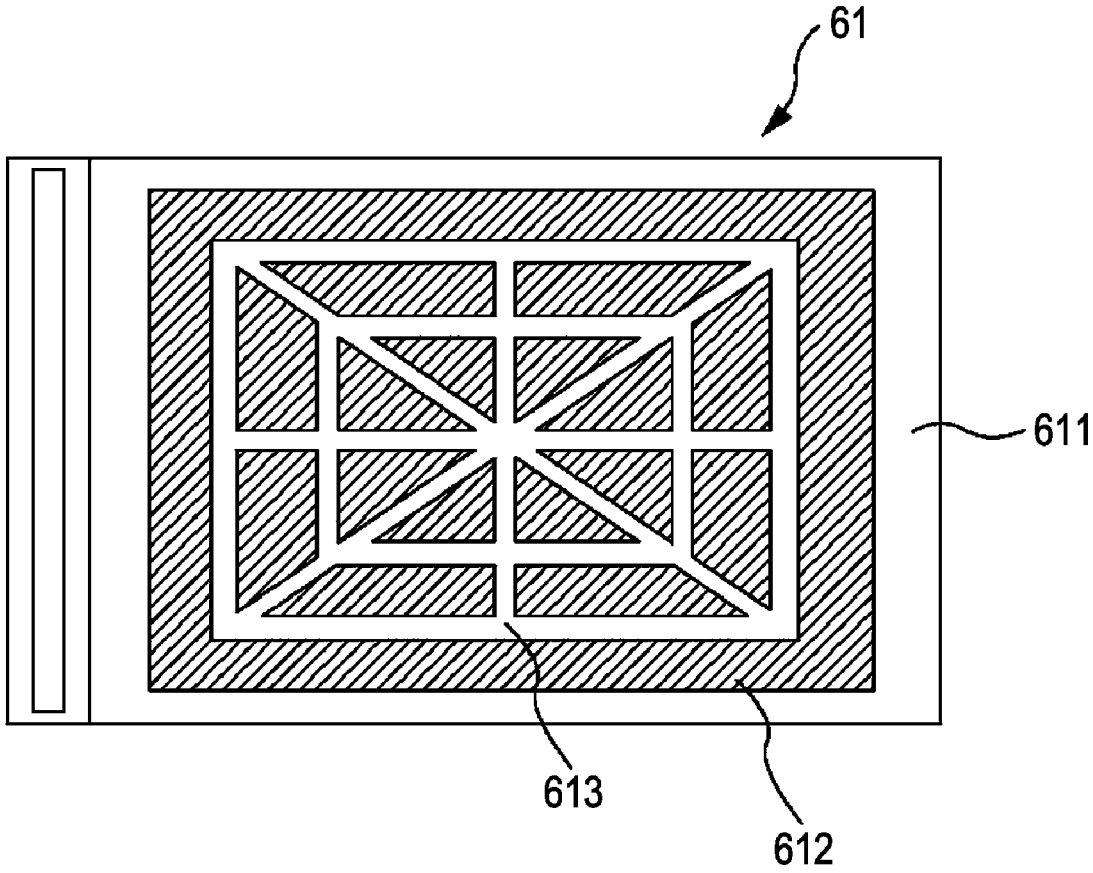
FIG. 4 is a diagram illustrating the cap view from an upper side.
Figure 5A:
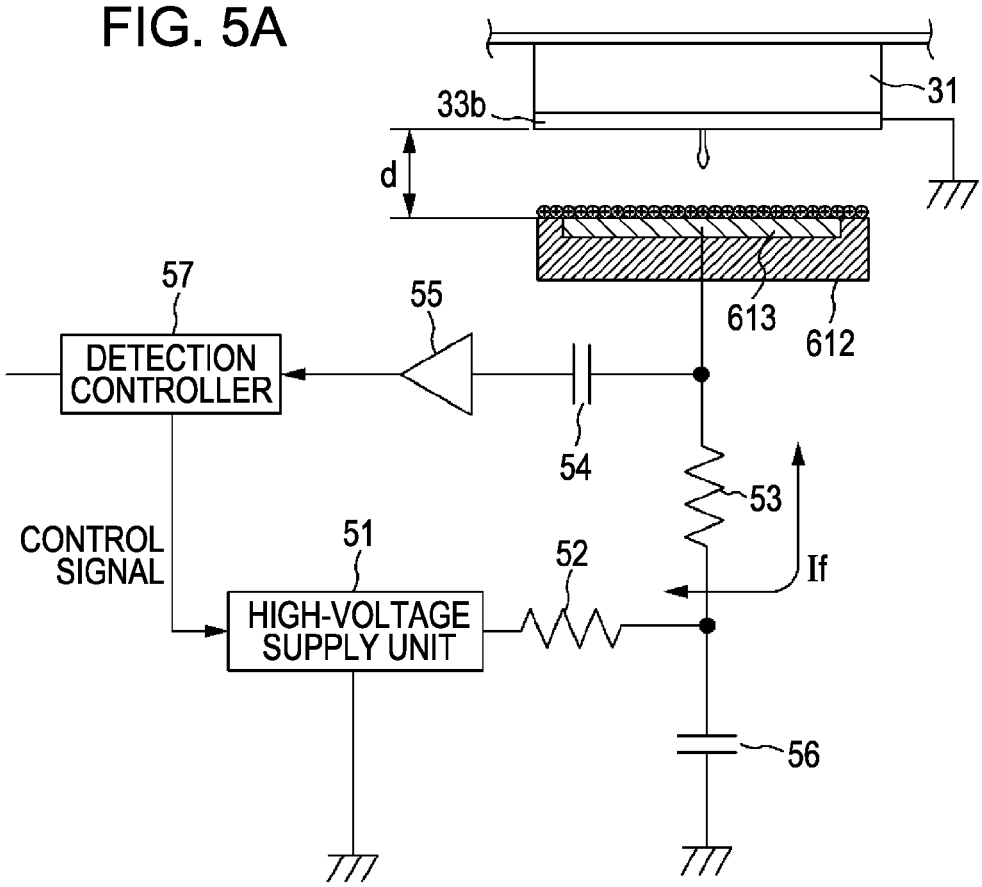
FIG. 5A is a diagram illustrating a missing dot detecting section.
Figure 5B:
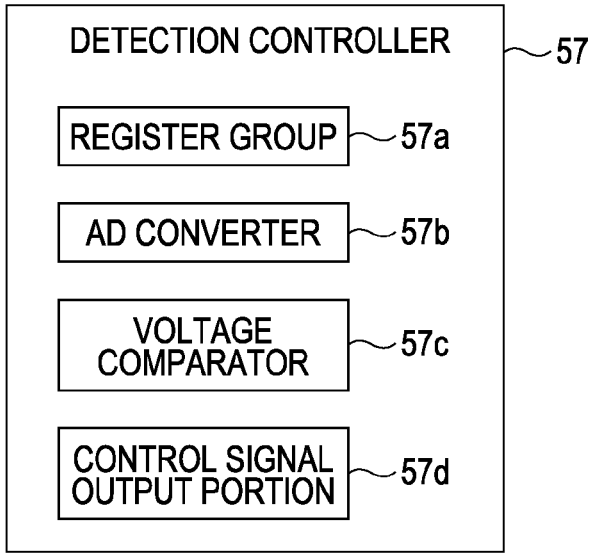
FIG. 5B is a block diagram illustrating a detection controller.

FIG. 4 is a diagram illustrating the cap 61 viewed from the upper side. FIG. 5A is a diagram illustrating the missing dot detecting section 50. FIG. 5B is a block diagram illustrating a detection controller 57. The missing dot detecting section 50 detects the dot missing nozzle by actually ejecting the ink from each nozzle and determining whether the ink is ejected normally. First, the configuration of the missing dot detecting section 50 will be described. As shown in FIG. 5A, the missing dot detecting section 50 includes a high-voltage supply unit 51, a first limitation resistor 52, a second limitation resistor 53, a detecting capacitor 54, an amplifier 55, and a smoothing capacitor 56, and the detection controller 57.

Upon detecting the missing dots, the nozzle surface faces the cap 61, as shown in FIGS. 3B and 5A. A moisturizing member 612 and a wiring-shaped detecting electrode 613 are disposed in the space surrounded by the side wall 611 of the cap 61, as shown in FIG. 4. The detecting electrode 613 is charged with a high potential of about 600 V to about 1 kV in a missing dot detecting operation. The detecting electrode 613 exemplified in FIG. 4 includes a frame having a double rectangular shape, a diagonal portion connecting the opposite angles of the frame to each other, and a cross portion connecting the middle points of the sides of the frame to each other. With such a configuration, electricity is uniformly charged over a broad range. A liquid (for example, water) having conductivity is used as the ink solvent according to this embodiment. When the detecting electrode 613 is charged with a high potential in the state where the moisturizing member 612 is humid, the surface of the moisturizing member 612 is also charged with the same potential. Accordingly, the area to which the ink is ejected from the nozzles is uniformly charged over a broad range.

The high-voltage supply unit 51 is a unit which supplies a predetermined potential to the detecting electrode 613 in the cap 61. The high-voltage supply unit 51 according to this embodiment is formed by a direct-current power source supplying a voltage of about 600 V to about 1 kV and the operation of the high-voltage supply unit is controlled in accordance with a control signal from the detection controller 57.

The first limitation resistor 52 and the second limitation resistor 53 are disposed between an output terminal of the high-voltage supply unit 51 and the detecting electrode 613 to limit the current flowing between the high-voltage supply unit 51 and the detection electrode 613. In this embodiment, the first limitation resistor 52 and the second limitation resistor 53 have the same resistant value (for example, 1.6 MΩ). The first limitation resistor 52 and the second limitation resistor 53 are connected to each other in series. As illustrated, one end of the first limitation resistor 52 is connected to the output terminal of the high-voltage supply unit 51, the other end of the first limitation resistor 52 is connected to one end of the second limitation resistor 53, and the other end of the second limitation resistor 53 is connected to the detecting electrode 613.

The detecting capacitor 54 is an element for extracting a potential varying component of the detecting electrode 613. One conductor thereof is connected to the detecting electrode 613 and the other conductor is connected to the amplifier 55. Since a bias component (a direct-current component) of the detecting electrode 613 can be removed by interposing the detecting capacitor 54, a signal can be easily handled. In this embodiment, the capacitance of the detecting capacitor 54 is 4700 pF.

The amplifier 55 amplifies and outputs a signal (potential variation) of the other end of the detecting capacitor 54. The amplifier 55 according to this embodiment is configured such that an amplification ratio is 4000 times. With such a configuration, the potential varying component can be acquired as a voltage signal having the variation width of about 2 V to about 3 V. A pair of the detecting capacitor 54 and the amplifier 55 corresponds to a kind of detector and detects a variation in the potential of the detecting electrode 613, which is caused due to the ejection of the ink droplets.

The smoothing capacitor 56 restrains the abrupt variation in the potential. One end of the smoothing capacitor 56 according to this embodiment is connected to a signal line connecting the first limitation resistor 52 to the second limitation resistor 53. The other end of the smoothing capacitor 56 is connected to the grand line. The capacitance of the smoothing capacitor 56 is 0.1 μF.

The detection controller 57 is a unit for controlling the missing dot detecting section 50. As shown in FIG. 5B, the detection controller 57 includes a resister group 57*a*, an AD converter 57*b*, a voltage comparator 57*c*, and a control signal output portion 57*d*. The resistor group 57*a* is constituted by plural resistors. Each of the resistors stores the determination result or a detecting voltage threshold value of each nozzle Nz. The AD converter 57*b* converts a voltage signal (having an analog value) output from the amplifier 55 and amplified into a voltage signal having a digital value. The voltage comparator 57*c* compares the size of an amplitude value based on the amplified voltage signal to the voltage threshold value. The control signal output portion 57*d* outputs a control signal for controlling the operation of the high-voltage supply unit 51.

Overview of Ejection Inspection

Next, the overview of the ejection inspection executed by the missing dot detecting section 50 will be described. As described above, in the printer 1, the nozzle plate 33*b* (corresponding to a first electrode) is connected to the grand line to be charged with the grand potential (corresponding to a first potential) and the detecting electrode 613 (corresponding to a second electrode) disposed in the cap 61 is charged with a high potential (corresponding to a second potential) of about 600 V to about 1 kV. The ink droplet ejected from the nozzles Nz are charged with the grand potential by the nozzle plate charged with the grand potential. The nozzle plate 33*b* and the detecting electrode 613 are disposed at a predetermined distance d (see FIG. 5A) and the ink droplets are ejected from the target nozzles Nz. In addition, an electric variation (a periodic variation in potential) caused due to the ejection of the ink droplets in the detecting electrode 613 is acquired by the detection controller 57 (corresponding to an inspector) through the detecting capacitor 54 and the amplifier 55. The detection controller 57 determines whether the ink droplets are normally ejected from the target nozzles Nz, based on the acquired periodic variation.

A detection principle is not clearly explained, but it can be considered that the nozzle plate 33*b* and the detecting electrode 613 operate like a capacitor since the nozzle plate 33*b* and the detecting electrode 613 are disposed at the predetermined distance d. As shown in FIG. 5A, the ink lengthened in a columnar shape from the nozzles Nz becomes the grand potential by bringing the ink into contact with the nozzle plate 33*b* connected to the grand line. It is considered that the presence of the ink varies the electrostatic capacitance of the capacitor. That is, the ink charged with the grand potential and the detecting electrode 613 form the capacitor and thus the electrostatic capacitance is varied with the ejection of the ink (the ink lengthened in the columnar shape). In this case, when the electrostatic capacitance becomes small, electric charge accumulated between the nozzle plate 33*b* and the detecting electrode 613 decreases. For this reason, surplus electric charge moves from the detecting electrode 613 to the high-voltage supply unit 51 through the limitation resistors 52 and 53. That is, current flows toward the high-voltage supply unit 51. Alternatively, when the electrostatic capacitance increases or the decreased electrostatic capacitance returns, the electric charge moves from the high-voltage supply unit 51 to the detecting electrode 613 through the limitation resistors 52 and 53. That is, current flows toward the detecting electrode 613. When this current flows (also referred to as an ejection inspection current If for convenience), the potential of the detecting electrode 613 is varied. The variation in the potential of the detecting electrode 613 is caused as a variation in the potential of the other conductor (the conductor close to the amplifier 55) of the detecting capacitor 54. Accordingly, by monitoring the variation in the potential of the other conductor, it is possible to determine whether the ink droplets are ejected.

Figure 6A:
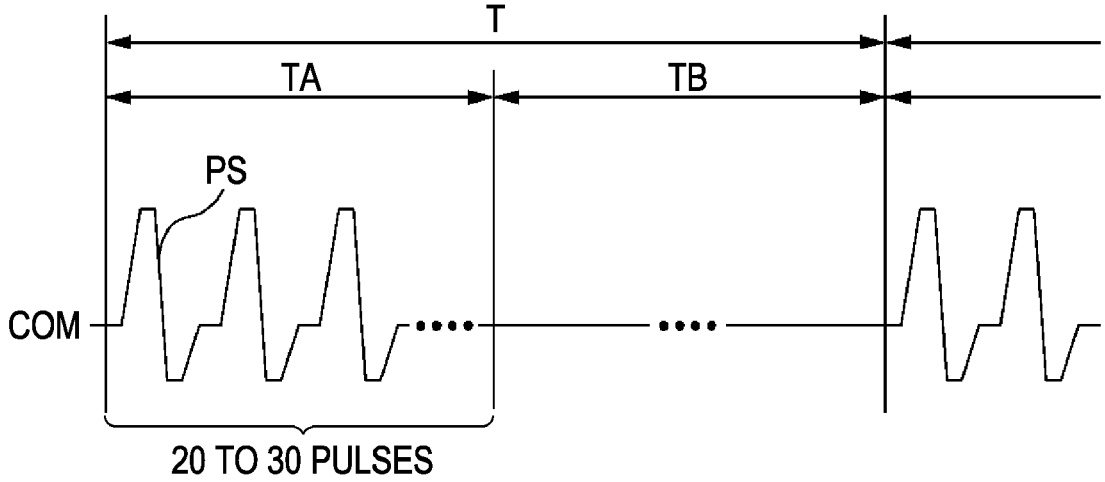
FIG. 6A is a diagram illustrating a driving signal.
Figure 6B:
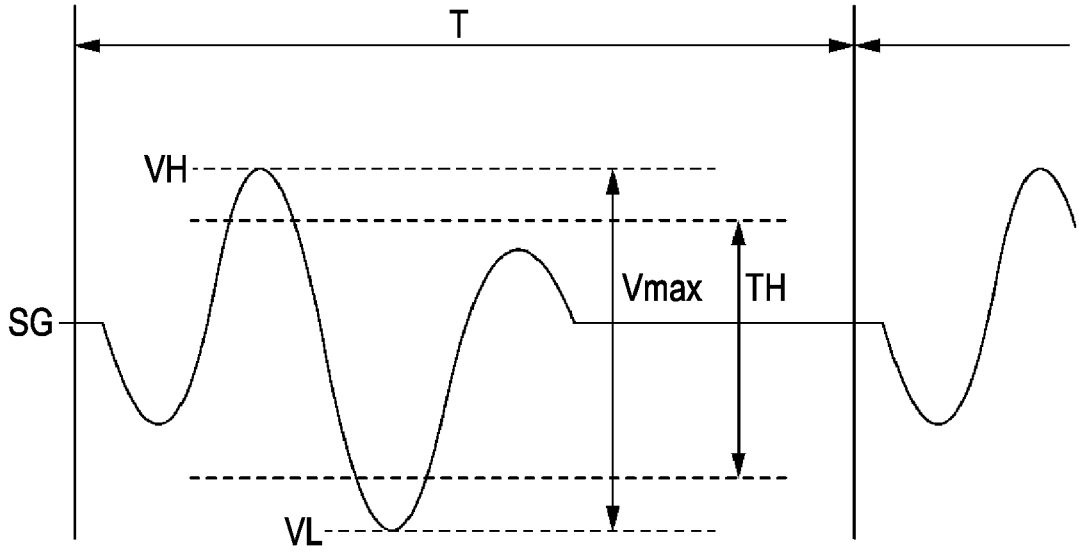
FIG. 6B is a diagram illustrating a voltage signal.

FIG. 6A is a diagram illustrating an example of the driving signal COM in the ejection inspection. FIG. 6B is a diagram illustrating a voltage signal SG output from the amplifier 55 when the ink is ejected from the nozzles Nz by the driving signal COM of FIG. 6A. The driving signal COM has plural pulses PS (twenty to thirty pulses at a 50 kHz period) to eject the ink from the nozzles Nz in a first-half period TA of a repetition period T. A uniform potential is maintained with an intermediate potential in a second-half period TB. The driving signal generation circuit 40 repeatedly generates the driving signal COM in every repetition period T. The repetition period T corresponds to the time (for example, 1 kHz) required to inspect one nozzle Nz.

When the driving signal COM is applied to the piezoelectric elements PZT, the ink droplets are continuously ejected from the nozzles Nz corresponding to the piezoelectric elements PZT twenty to thirty times at a 50 kHz period. In this way, the potential of the detecting electrode 613 is varied and the amplifier 55 outputs the potential variation, which is used as the voltage signal SG shown in FIG. 6B, to the detection controller 57. The detection controller 57 calculates the maximum amplitude Vmax (a difference between the maximum voltage VH and the minimum voltage VL) from the voltage signal SG generated in an inspection period of the target nozzles Nz and compares the maximum amplitude Vmax and the predetermined threshold value TH. When the ink is ejected from the target nozzles Nz, as shown in FIG. 6B, the maximum amplitude Vmax becomes larger than a threshold value TH. On the other hand, when the ink is not ejected due to the clogging of the target nozzles Nz, the potential of the detecting electrode 613 is not varied and the maximum amplitude Vmax of the voltage signal SG is equal to or larger than the threshold value TH.

In summary, in this embodiment, whether the dot missing nozzles exist is determined by whether the ink droplets are actually ejected from the target nozzles Nz. For this determination, the driving signal COM for the ejection inspection (see FIG. 6A) is applied to the piezoelectric elements PZT corresponding to the target nozzles Nz. By maintaining the nozzle plate 33*b* with the grand potential and providing the detecting electrode 613 with a high-voltage in the cap 61, the ejection of the ink droplets from the nozzles Nz can be known by the variation in the potential of the detecting electrode 613. Specifically, the detection controller 57 determines whether the ink droplets are ejected from the target nozzles Nz by comparing the maximum amplitude Vmax of the voltage signal SG (see FIG. 6B) formed based on the variation in the potential of the detecting electrode 613 to the predetermined threshold value.

Non-Ejection Dummy Period

Figure 7A:
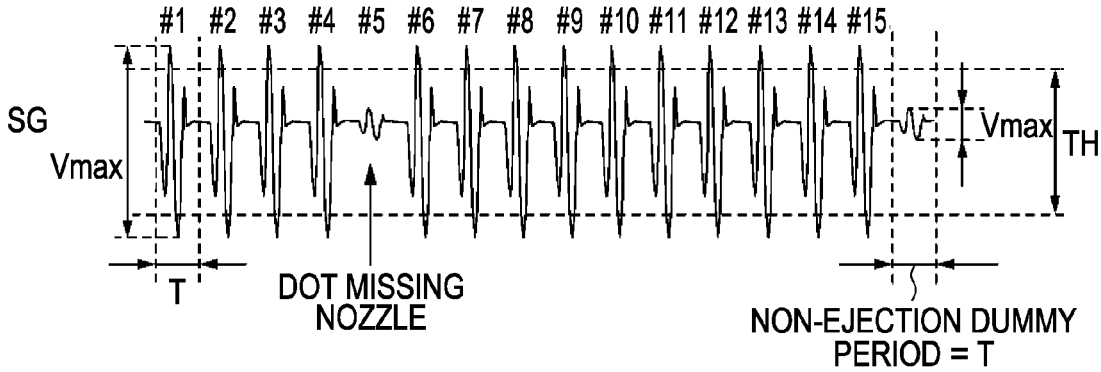
FIG. 7A is a diagram illustrating a voltage signal in which no noise occurs.
Figure 7B:
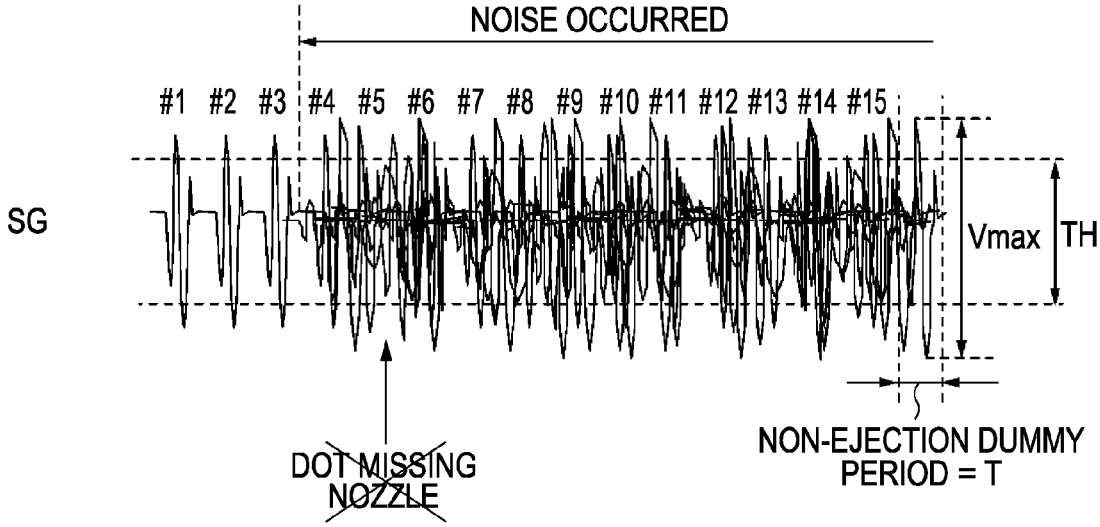
FIG. 7B is a diagram illustrating a voltage signal in which a noise occurs.

FIG. 7A is a diagram illustrating the voltage signal SG when the ejection inspection is normally executed without a noise during the ejection inspection. FIG. 7B is a diagram illustrating the voltage signal SG when a noise occurs during the ejection inspection. The drawings show the results (the voltage signals SG) of the ejection inspection from nozzle #1 to nozzle #15. As described above, it is determined in the ejection inspection whether the nozzles Nz miss the dots by comparing the maximum amplitude Vmax in an inspection period T of each nozzle Nz to the threshold value TH. For example, in the voltage signal SG shown in FIG. 7A, it is determined that the missing dot does not exist in nozzle #1, since the maximum Vmax of nozzle #1 is larger than the threshold value TH. However, it is determined that the missing dot exists in nozzle #5, since the maximum amplitude Vmax for nozzle #5 is equal to or smaller than the threshold value TH.

In this case, when mechanical vibration (impact) occurs during the ejection inspection or the ejection inspection current If flowing toward the detecting electrode 613 leaks, as shown in FIG. 7B, a noise may occur in the voltage signal SG. For example, when a user sets sheets in a tray of the printer 1, the mechanical vibration occurs in the printer 1 and thus a noise may occur in the voltage signal SG. Alternatively, a noise may occur in the voltage signal SG when the ejection inspection current If leaks due to the attachment of foreign conductive matters to a space between the nozzle surface and the detecting electrode 613 or when the ejection inspection current If leaks through the ink overflowing from the cap 61 or the ink attached to the wiper 66.

When a noise of which the maximum amplitude exceeds the threshold value TH occurs in the ejection inspection period, as shown in FIG. 7B, the ejection inspection cannot be normally executed. For example, it is assumed that nozzle #5 is the dot missing nozzle. When no noise occurs in the ejection inspection period, as shown in FIG. 7A, the variation (the maximum amplitude Vmax) in the potential during the inspection period of nozzle #5 does not exceed the threshold value TH. However, when a noise occurs in the ejection inspection period, the variation (the maximum amplitude Vmax) in the potential of the noise during the inspection period of nozzle #5 exceeds the threshold value. Therefore, the detection controller 57 wrongly determines that the ink droplets have normally been ejected from nozzle #5. Then, nozzle #5 is not detected as the dot missing nozzle and the printing is executed in a state where the recovery operation or the like is not executed. As a consequence, the quality of a print image may deteriorate.

When a noise occurs in the voltage signal SG in the ejection inspection period, the dot missing nozzle cannot be exactly detected. In this embodiment, therefore, "a non-ejection dummy period" (corresponding to a non-ejection period) is provided in the ejection inspection period to determine whether a noise occurs in the ejection inspection period. The non-ejection dummy period refers to a period in which the ink droplets are ejected from all of the nozzles Nz. The non-ejection dummy period is provided during the ejection inspection of the plural nozzles Nz. For example, the non-ejection dummy period is provided in FIG. 7A after the ejection inspection is executed from nozzle #1 to nozzle #15.

When no noise occurs in the ejection inspection period, as shown in FIG. 7A, the maximum value (the maximum amplitude Vmax) of the variation in the voltage in a non-ejection dummy period is also equal to or smaller than the threshold value TH. When the maximum amplitude Vmax of the non-ejection dummy period is equal to or smaller than the threshold value TH, it can be determined that no noise has occurred in the voltage signal SG in the ejection inspection periods of nozzle #1 to nozzle #15 before the non-ejection dummy period. That is, the ejection inspection of nozzle #1 to nozzle #15 is normally executed, and thus it can be determined that the inspection result obtained by detecting the missing dots by the use of the voltage signal SG is right.

However, when a noise occurs in the ejection inspection period, as shown in FIG. 7B, the maximum amplitude Vmax of the non-ejection dummy period becomes larger than the threshold value TH. Accordingly, when the maximum value of the variation in the potential in the non-ejection dummy period is larger than the threshold value TH, it can be determined that the noise has occurred in the voltage signal SG in the ejection inspection periods of nozzle #1 to nozzle #15 before the non-ejection dummy period. That is, since the ejection inspection of nozzle #1 to nozzle #15 is executed in an abnormal state of a function of the printer 1, it can be determined that the inspection result obtained by detecting the missing dots by the use of the voltage signal SG is not right.

In this way, by providing the non-ejection dummy period between the ejection inspections of the nozzles Nz, it is possible to exactly detect the dot missing nozzle by the use of the voltage signal SG in which no noise occurs. Moreover, by executing the printing after the recovery operation or the like is executed upon detecting the dot missing nozzle, it is possible to prevent the quality of a print image from deteriorating. A factor causing a noise exists in the resistant elements of the missing dot detecting section 50. Therefore, even though no great noise occurs due to the mechanical vibration or the leakage of the ejection inspection current If, as in the non-ejection dummy period of FIG. 7A, a noise having a small amplitude may occur.

Figure 8:
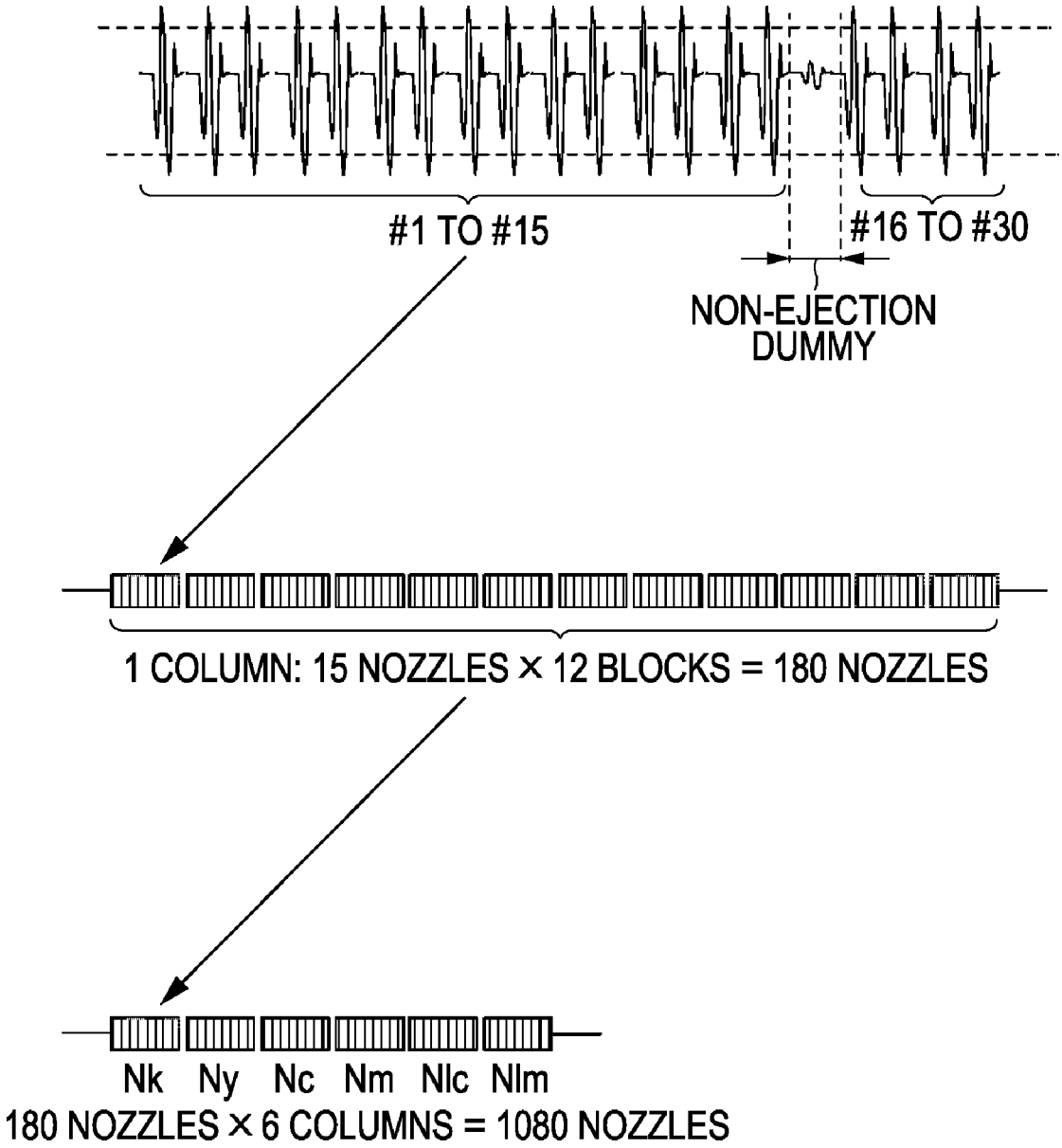
FIG. 8 is a diagram illustrating a block as an ejection inspection unit.

FIG. 8 is a diagram illustrating a block as an ejection inspection unit. As described in FIG. 2B, six nozzle arrays Nk to Nlm are provided in the head 31 used in the printer 1 according to this embodiment. Each of the nozzle arrays Nk to Nlm is constituted by 180 nozzles Nz. Therefore, 1080 (180 nozzles×6 columns) nozzles Nz are ejection inspection targets. In this embodiment, it is assumed that 15 nozzles Nz are ejection inspection unit (hereinafter, referred to as a block) and the ejection inspection is executed in unit of the block. That is, one nozzle array is divided into twelve blocks and the total seventy two blocks are subjected to the ejection inspection.

The "non-ejection dummy period" used to check whether a noise occurs in the voltage signal SG is provided between an inspection period of a certain block and the inspection period of the next block. Accordingly, in the driving signal COM for the ejection inspection in FIG. 6A, the period (the non-ejection period) having no pulse PS is provided after the repetition period T having twenty to thirty pulses PS is repeated 15 times. The invention is not limited thereto. For example, the repetition period T having the pulses PS may be repeated and a switch or the like may be controlled so as not to apply the driving signal COM to all the piezoelectric elements PZT in the non-ejection dummy period.

When the maximum amplitude Vmax in a certain non-ejection dummy period exceeds the threshold value TH, the ejection inspection (the ejection inspection of fifteen nozzles) of the previous block becomes invalid. When the ejection inspection of a certain block is nullified, the ejection inspection is again executed. Alternatively, when the maximum amplitude Vmax in a certain non-ejection dummy period is equal to or smaller than the threshold value TH, the ejection inspection of the previous block becomes valid and the ejection inspection of the subsequent block is executed (the details of which are described below).

It is preferable that the non-ejection dummy period is equal to a period necessary to execute the ejection inspection of one nozzle Nz, that is, has the same length as that of the repetition period T of the driving signal COM shown in FIG. 6A. When the non-ejection dummy period is shorter than the repetition period T, the non-ejection dummy period becomes shorter than one period of a noise. Therefore, the maximum amplitude Vmax of the noise may not be detected. Then, whether the noise occurs cannot be exactly detected. On the contrary, when the non-ejection dummy period is nearly equal to the period necessary to execute the ejection inspection of one nozzle Nz, it is sufficient to acquire the maximum amplitude Vmax of the noise. Therefore, when the non-ejection dummy period is much longer than the period necessary to execute the ejection inspection of one nozzle Nz, the time taken to execute the ejection inspection becomes long.

Moreover, in the ejection inspection of each nozzle Nz, the voltage comparator 57*c* of the detection controller 57 acquires the maximum amplitude Vmax by the use of the maximum value VH and the minimum value VL of the voltage signal SG (a digital signal) in each repetition period T. Therefore, it can be checked whether the noise occurs in the non-ejection dummy period and the management of the period can be easily controlled by allowing the voltage comparator 57*c* to acquire the maximum amplitude Vmax from the variation in the voltage in the same period (the repetition period T). That is, it is possible to prevent the inspection period from becoming longer, since the management of the period can be easily controlled by allowing the non-ejection dummy period to be nearly equal to the period T necessary to execute the ejection inspection of one nozzle and it can be checked whether the noise occurs as exactly as possible.

Here, the non-ejection period is provided in every block constituted by fifteen nozzles, but the invention is not limited thereto. For example, the non-ejection dummy period may be provided in every ejection inspection of one nozzle. The invention is also limited to the configuration in which the non-ejection dummy period is provided after the block. For example, the non-ejection dummy period may be provided before the ejection inspection of the block to determine whether the noise occurs in the next ejection inspection, or the non-ejection dummy period may be provided during the ejection inspection of the block. In this embodiment, when it is determined that the noise has occurred in the ejection inspection period of a certain block in the non-ejection dummy period, the ejection inspection of the next block is not executed and the ejection inspection of the certain block is again executed (the details of which are described below). However, the invention is not limited thereto. For example, by providing the non-ejection dummy period between the blocks and checking the variation (the maximum amplitude Vmax) in the potential of the non-ejection dummy period, the block in which the noise has occurred may be inspected later after the ejection inspection of the plurality of all of the blocks ends. However, when a long noise occurs, the ejection inspection of the many blocks is not necessary. Therefore, whenever the ejection inspection of one block is executed, it may be checked whether the noise occurs based on the maximum amplitude Vmax of the non-ejection dummy period.

Optimum Number of Non-Ejection Dummy Periods

In this embodiment, as shown in FIG. 8, fifteen nozzles are set as one block (ejection inspection unit), and one non-ejection dummy period is provided whenever the ejection inspection of the fifteen nozzles Nz is executed. However, when the number of non-ejection dummy periods is large, a noise (hereinafter, also referred to as a short-term noise) occurring in a short period cannot be detected. Therefore, the detection precision of the noise can be improved. Moreover, when the number of non-ejection dummy periods is large, it takes a considerable time to execute the ejection inspection. Accordingly, hereinafter, a method (a method of setting the ejection inspection) of determining the optimum number of non-ejection dummy periods, that is, the optimum number of nozzles belonging to one block (hereinafter, also referred to as a unit block) will be described.

Figure 9A:
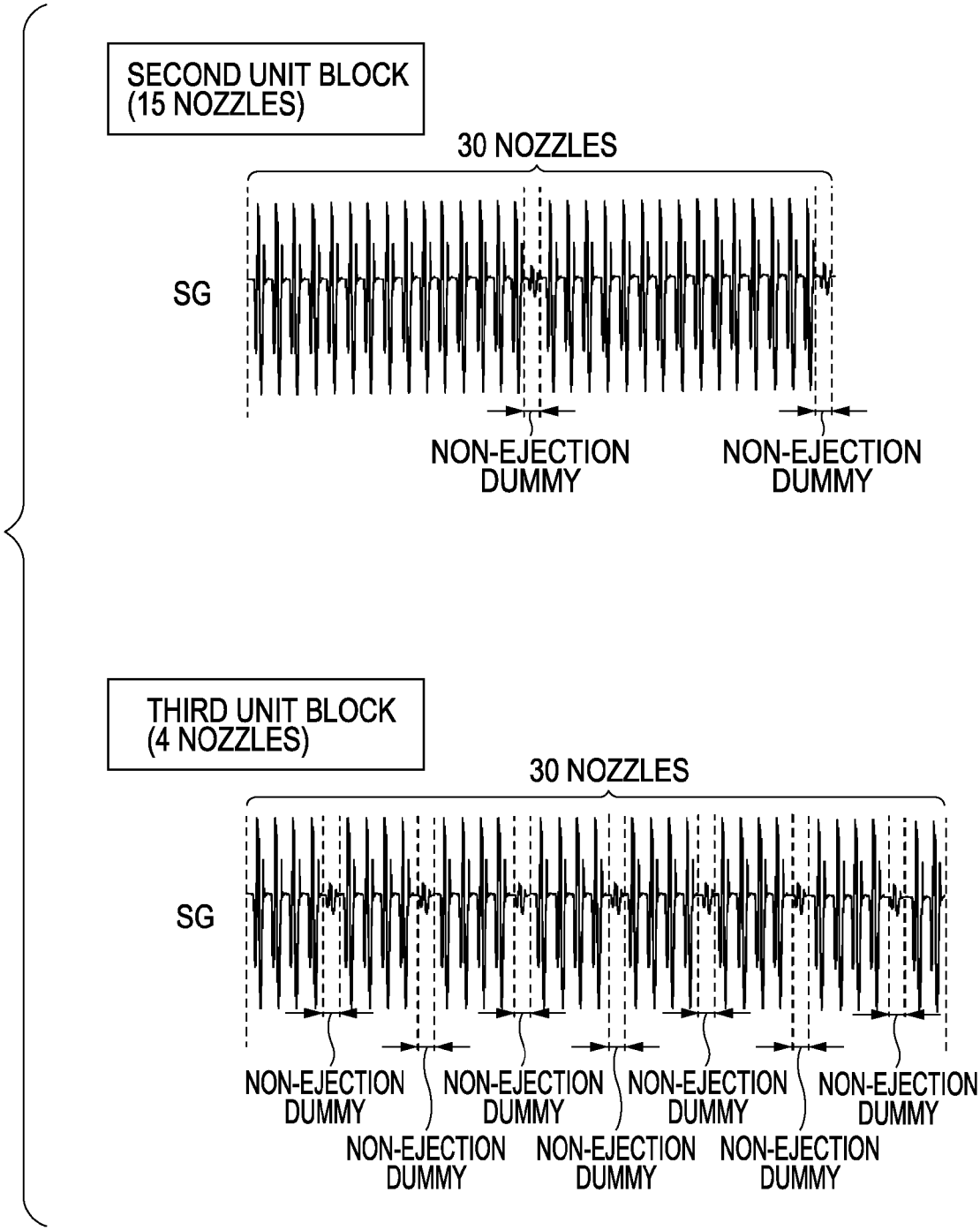
FIG. 9A is a diagram illustrating a difference in inspection periods.
Figure 9B:
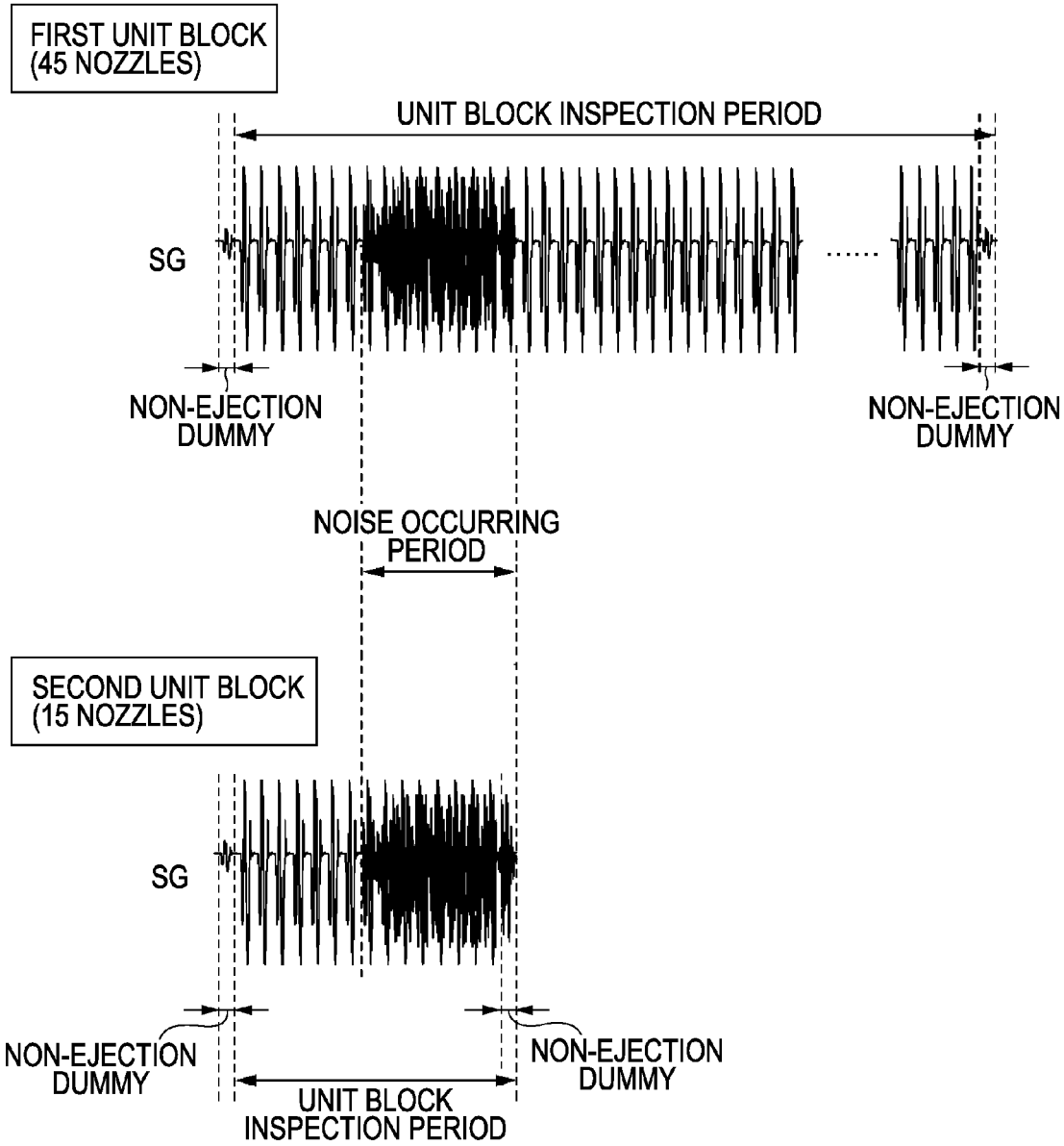
FIG. 9B is a diagram illustrating a difference in wrong detection rates.

FIG. 9A is a diagram illustrating a difference in inspection periods caused due to a difference of the number of nozzles belonging to the unit block. FIG. 9B is a diagram illustrating a difference in the wrong detection rates caused due to the difference of the number of nozzles belonging to the unit block. FIG. 9C is a table for summarizing the results of a test (hereinafter, also referred to as "a nozzle number determination test") for determining the optimum number of nozzles belonging to the unit block. In this embodiment, the optimum number of nozzles per the unit block for restraining the inspection period from becoming excessively long while obtaining the necessary detection precision is determined by carrying out "the nozzle number determination test" in the manufacturing process of the printer 1. Specifically, the ejection inspection is executed by varying the number of nozzles belonging to the unit block plural times.

Like the ejection inspection of the printer 1, in "the nozzle number determination test", the non-ejection dummy period is provided during the ejection inspection in every block by executing the ejection inspection on the nozzles belonging to the block. A test where a noise occurs in the voltage signal SG by intentionally making a disturbance during the test and a test where no disturbance is made are carried out. An action of a user setting sheets (media) in the printer 1 may be considered as a main cause of the noise (mechanical vibration) occurring in the ejection inspection period. Therefore, the disturbance is made by actually setting the sheets in the printer 1 during the test to cause the noise to the voltage signal SG. In this way, since the nozzle number determination test can be carried out in the environment of actually using the printer 1, the optimum number of nozzles belonging to the block can be determined. In the test of making a disturbance, it is assumed that the ejection inspection of the previous block is nullified and the ejection inspection is again executed (reinspection) when the maximum amplitude Vmax of the variation in the voltage in the non-ejection dummy period exceeds the threshold value, as in FIG. 7B. Alternatively, it is assumed that the ejection inspection of the next block is executed when the maximum amplitude Vmax of the non-ejection dummy period is equal to or smaller than the threshold value. The result of the nozzle number determination test shown in FIG. 9C is the result of the ejection inspection on one nozzle array. In addition, in the nozzle number determination test, it is assumed that all the voltage signals SG during the test are acquired and used when a wrong detection rate (which is described below) of the dot missing nozzles (failure nozzles) or the like is calculated. In a case where the ejection inspection is not normally executed even when an abnormality occurs in the printer 1 during the nozzle number determination test and the ejection inspection of a certain block is repeated a predetermined number of times, abnormal ending (ABEND) of the nozzle number determination test is executed.

In this embodiment, as shown in FIG. 9C, three candidates for the number of nozzles belonging to the unit block are selected. "Forty five nozzles (corresponding to the first number or a second number)" belong to a first unit block, "fifteen nozzles" belong to a second unit block, and "four nozzles" belong to a third unit block. The ejection inspection is carried out in each of the three kinds of unit block. Here, it is preferable that the number of nozzles belonging to the unit block is a common divisor (for example, forty five nozzles, fifteen nozzles, or four nozzles) of "180 nozzles" constituting the nozzle array. In this way, since the number of nozzles subjected to the ejection inspection in all the blocks is the same, the ejection inspection can be easily controlled. Moreover, when the result of the ejection inspection of the nozzles of each block is stored in the resistor of the detection controller 57, the memory of the resistor can be utilized as effectively as possible. As for the driving signal COM for the ejection inspection shown in FIG. 6A, the driving signal COM provided with the non-ejection dummy period may be prepared for the nozzle number determination test in every repetition period T of the number of nozzles (forty five nozzles, fifteen nozzles, and four nozzles) belonging to each unit block, or a switch or the like may be controlled so as not to apply the driving signal COM to the piezoelectric elements in each of the number of nozzles belonging to each unit block. In addition, the invention is not limited to the three candidates for the number of nozzles belonging to the unit block.

After the ejection inspection is executed by varying the number of nozzles belonging to the unit block plural times, the optimum number of nozzles belonging to the unit block is determined based on the result of the nozzle number determination test. In the result of the nozzle number determination test, the inspection periods (the total inspection period) of the ejection inspection are first compared for an explanation. FIG. 9A shows the difference in inspection periods in the second and third unit blocks. In FIG. 9A, the difference in the ejection inspection periods of thirty nozzles is shown. As the number of nozzles of the unit block is smaller, as shown in the drawing, the inspection period becomes longer. That is because the number of non-ejection dummy periods is increased. From the result of FIG. 9C, it can also be known that as the number of nozzles belonging to the unit block is smaller, the inspection period becomes longer due to the numerous number of non-ejection dummy periods. In addition, as the number of nozzles belonging to the unit block is smaller, the number of reinspections with a disturbance is increased. That is because it is easy to detect a short-term noise. Therefore, as the number of nozzles belonging to the unit block is smaller, the inspection period becomes longer.

Next, the wrong detection rates when a disturbance is made during the test will be compared. FIG. 9B shows that a noise having the same length occurs at the same time in the first and second unit blocks. As the number of nozzles belonging to the unit block, a probability that the short-term noise occur in the non-ejection dummy period is decreased. That is because an interval of the non-ejection dummy periods becomes longer. That is, even when the noise occurs during the detection of the missing dots of the nozzles Nz, it is determined that no noise has occurred in the non-ejection dummy period in many cases. Then, based on the voltage signal SG in which the noise occurs, it is determined that the missing dots of the nozzles Nz exist in many cases.

The wrong detection rate (corresponding to the error detection rate of the failure nozzles) shown in FIG. 9C is a ratio of the number of nozzles determined to miss the dots based on the maximum amplitude Vmax of the voltage signal SG in the period of the noise occurrence by a disturbance to the number of nozzles (180 nozzles) to be detected. From the result of the wrong detection rate shown in FIG. 9C, it can also be known that as the number of nozzles belonging to the unit block, the wrong detection rate is increased.

The inspection period without a disturbance and the inspection period with a disturbance in FIG. 9C are compared to each other. The difference in the inspection periods with the disturbance is decreased in that the difference in the inspection periods without a disturbance is "0.5 seconds" and the difference in the inspection periods with a disturbance is "0.38 seconds" in the first and second unit blocks. That is because when the number of nozzles belonging to the unit block is increased, a noise occurs in the non-ejection dummy period and thus time necessary for reinspection becomes longer upon executing the reinspection. That is, when the number of nozzles belonging to the unit block is numerous, the number of nozzles inspected in a period in which a short-term noise occurs may be larger than the number of nozzles normally inspected in the period in which no noise occurs. Even in this case, when the reinspection is executed, a period of repeating the ejection inspection unnecessarily becomes longer.

In this way, by executing the ejection inspection by varying the number of nozzles belonging to the unit block plural times as "the nozzle number determination test", the optimum number of nozzles belonging to the unit block is determined based on the calculated inspection period and the wrong detection rate. From the result shown in FIG. 9C, the inspection period of the third unit block becomes longer by about 3 seconds than the inspection periods of the first and second blocks. On the contrary, the inspection period of the second unit block becomes just longer by 0.5 seconds than the inspection period of the first unit block. However, the wrong detection rate can be made lower in the second block than in the first unit block. Accordingly, in this embodiment, it is determined that the number of nozzles belonging to the unit block is fifteen.

That is, in this embodiment, the number of nozzles belonging to the unit block is determined in consideration of the inspection period and the wrong detection rate necessary for the ejection inspection. In addition, the number of nozzles belonging to the unit block is stored in the memory 80*c* of the printer 1. In this way, upon executing the ejection inspection, the printer controller 80 can control the non-ejection dummy period based on the driving signal COM (see FIG. 6A) for the ejection inspection whenever the ejection inspection is executed on the fifteen nozzles. As a consequence, it is possible to make the inspection period as short as possible, while keeping the detection precision of the ejection inspection.

Here, the series of operations are executed by the computer CP connected externally to the printer 1 in the manufacturing process. For example, a program for determining the number of nozzles belonging to the unit block, that is, a program (hereinafter, also referred to as a nozzle number determination program) for executing the nozzle number determination test is installed on the computer CP. After a designer (a user) inputs the candidates (here, forty five nozzles, fifteen nozzles, and four nozzles) for the number of nozzles belonging to the unit block, the nozzle number determination program sets the number of nozzles belonging to the unit block as the input number of nozzles and allows the printer 1 to execute the ejection inspection. As shown in FIG. 9C, the nozzle number determination program calculates the inspection period and the wrong detection rate of each unit block and displays the calculated inspection period and wrong detection rate on a display or the like. Based on the displayed inspection period and wrong detection rate, the designer inputs the number of nozzles belonging to the unit block and stores the number of nozzles per the input unit block in the memory 80*c* of the printer 1. In this way, when the ejection inspection is executed under the control of the user of the printer 1, the non-ejection period for each optimum number of nozzles is provided. Alternatively, the nozzle number determination program may determine the candidate for the number of nozzles belonging to the unit block.

The invention is not limited thereto, but the nozzle number determination program may determine the optimum number of nozzles belonging to the unit block based on the calculated inspection period and wrong detection rate. In this case, the nozzle number determination program allows the designer to input the allowed inspection period (or the wrong detection rate). The nozzle number determination program (the computer CP) determines the number of nozzles belonging to the unit block based on the inspection period (or the wrong detection rate) input by the user and the result of the inspection period and the wrong detection rate of each unit block. For example, when the user inputs "8 seconds" as an allowed value of the total inspection period with a disturbance, the nozzle number determination program determines the number of nozzles belonging to the unit block based on the unit block (here, the second unit block) having the lowest wrong detection rate among the unit blocks having the inspection period of 8 seconds from the result shown in FIG. 9C. In this way, it is possible to improve detection precision of the ejection inspection, while keeping the allowed inspection period.

Alternatively, the number of nozzles belonging to the unit block may not be fixed to fifteen, but the number of nozzles belonging to the unit block may be determined by storing the result of the inspection periods and the wrong detection rates where the number of nozzles belonging to the unit block is different in the memory 80*c* of the printer 1 and by allowing the user (the printer 1) to select the number of nozzles. For example, a printer driver (or the nozzle number determination program) allows the user to select which is important between the inspection period and the wrong detection rate. When the user considers the wrong detection rate to be more important, the printer driver selects the number of nozzles belonging to the unit block so that the wrong detection rate becomes the lowest in the allowed inspection periods, by allowing the user to select the allowed inspection period. On the contrary, when the user considers the inspection period to be more important, the printer drive selects the number of nozzles belonging to the unit block so that the inspection period becomes the shortest in the allowed wrong detection rates. The allowed inspection periods or the allowed wrong detection rates are set in advance by the designer, and it may be configured so that the user of the printer 1 selects one of "a speed" and "a high definition".

Modified Examples of Wrong Detection Rate

The wrong detection rate of the dot missing nozzle described above is a ratio of the number of nozzles determined to miss the dots based on the maximum amplitude Vmax of the voltage signal SG in the period of the noise occurrence by a disturbance to the number of target nozzles. However, the invention is not limited thereto, but the nozzle number determination test may be carried out after "the dot missing nozzles" are set.

For example, the plural nozzles #i are set as "the dot missing nozzles" and the liquid is intentionally not ejected in the ejection inspection of the nozzles #i. By doing so, the wrong detection rate may be calculated based on whether the nozzles #i are surely detected as "the dot missing nozzles" from the result obtained from the ejection inspection. Alternatively, the wrong detection rate may be calculated based on whether the nozzles (the nozzles normally ejecting ink) which are not the nozzles #i are detected as "the dot missing nozzles". However, in the nozzle number determination test, it is assumed that the ink is normally ejected from all of the nozzles.

Detection of Abnormality in Detecting Electrode 613

The missing dot detecting section 50 allows the detecting electrode 613 to be charged with a high voltage of 600 V to 1 kV. As described above, an abnormality such as a short circuit may occur in the detecting electrode 613 since the ejection inspection current If leaks due to the attachment of foreign conductive matters to a space between the nozzle surface and the detecting electrode 613 or since the ejection inspection current If leaks through the ink overflowing from the cap 61 or the ink attached to the wiper 66. When the abnormality occurs in the detecting electrode 613, the ejection of the ink cannot be normally detected.

In order to detect the abnormality of the detecting electrode 613, a voltage dividing circuit is generally provided in a power supply line for charging the detecting electrode 613. That is, the power supply voltage is divided by the voltage dividing circuit to acquire a detection voltage having a voltage level suitable for the detection. In addition, by converting the voltage value of the detection voltage into a digital form, the abnormality in the detecting electrode 613 is detected.

However, when the abnormality is detected using the voltage dividing circuit, a problem arises in that the charge as a signal source to be used for the missing dot detection leaks through the voltage dividing circuit and thus detection sensitivity deteriorates. Moreover, a problem also arises in that a current noise or a thermal noise is increased due to the numerous resistant elements in the causes of the noise occurring in the resistant elements. It is difficult to completely remove such noises in a circuit handling high-voltage signals.

In view of such a circumstance, in the missing dot detecting section 50, the voltage level is not monitored using the voltage dividing circuit, but the abnormality in the detecting electrode 613 is detected based on a variation in an electric status caused by the ejection inspection current If. That is, it is determined whether the detecting electrode 613 is normal or not based on the magnitude of the amplitude of the voltage signal SG acquired by allowing the amplifier 55 to amplify the variation in the potential of the other conductor of the detecting capacitor 54.

Figure 10:
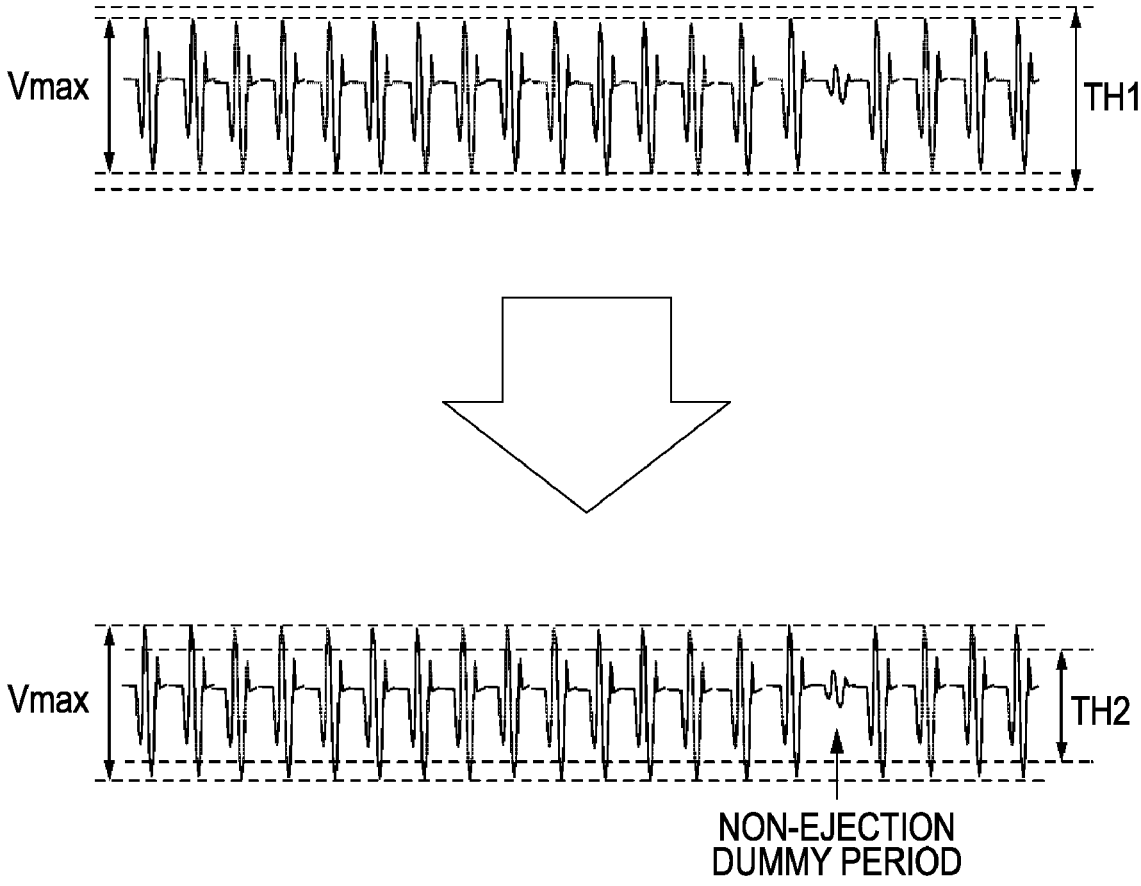
FIG. 10 is a diagram illustrating abnormality detection of a detecting electrode.

FIG. 10 is a diagram illustrating the detection of the abnormality in the detecting electrode 613. Here, when the ejection inspection current If leaks from the detecting electrode 613 and the abnormality thus occurs in the detecting electrode 613, the maximum amplitude Vmax for all of the nozzles Nz is decreased. Therefore, a first threshold value TH1 (corresponding to the above-described threshold value TH and 3 V here) is set for the maximum amplitude Vmax of the voltage signal SG acquired from the ejection inspection. When the maximum amplitude Vmax for all of the nozzles Nz belonging to a certain block is equal to or larger than 3 V (and when no noise occurs in the non-ejection dummy period), no abnormality occurs in the detecting electrode 613 during the ejection inspection of the certain block and it can be determined that the missing dot does not exist in all of the nozzles belonging to the certain block.

In the missing dot detecting section 50, a second threshold value TH2 having the voltage level lower by a predetermined voltage level than that of the first threshold value TH1 is determined in consideration of the fact that the maximum amplitude Vmax for all of the nozzles Nz is decreased when the abnormality occurs. That is, when the maximum amplitude Vmax for all of the nozzles Nz is equal to or smaller than the first threshold value TH1, as shown in FIG. 10, the ejection inspection is again executed by changing the threshold value into the second threshold value TH2 (for example, 2.5 V). In addition, the detection controller 57 determines that the ejection inspection current If leaks due to a short circuit, when the maximum amplitude Vmax for all of the nozzles Nz is equal to or smaller than the first threshold value TH1 and larger than the second threshold value TH2 in the inspection period other than the non-ejection dummy period, in other words, when a degree of the variation in the potential amplified by the amplifier 55 is within the range defined by the first threshold value TH1 and the second threshold value TH2. The determination result is output to the printer controller 80. The printer controller 80 executes a process or the like of receiving the determination result and stopping the operation of the printer 1 (which is described below).

It is preferable that the second threshold value TH2 is a value higher than the noise typically occurring in the non-ejection dummy period. As described above, in the resistant elements, there are the causes of the noise. This noise may be amplified to some extent, since the noise is amplified by the amplifier 55. In this embodiment, by allowing the second threshold value TH2 to be larger than the noise typically occurring in the non-ejection dummy period, it is possible to permit the tiny noise typically occurring to rarely have an influence on the ejection inspection. In this way, it is possible to improve detection precision of the electric variation occurring by the ink ejection.

Flow of Missing Dot Detection

Figure 11:
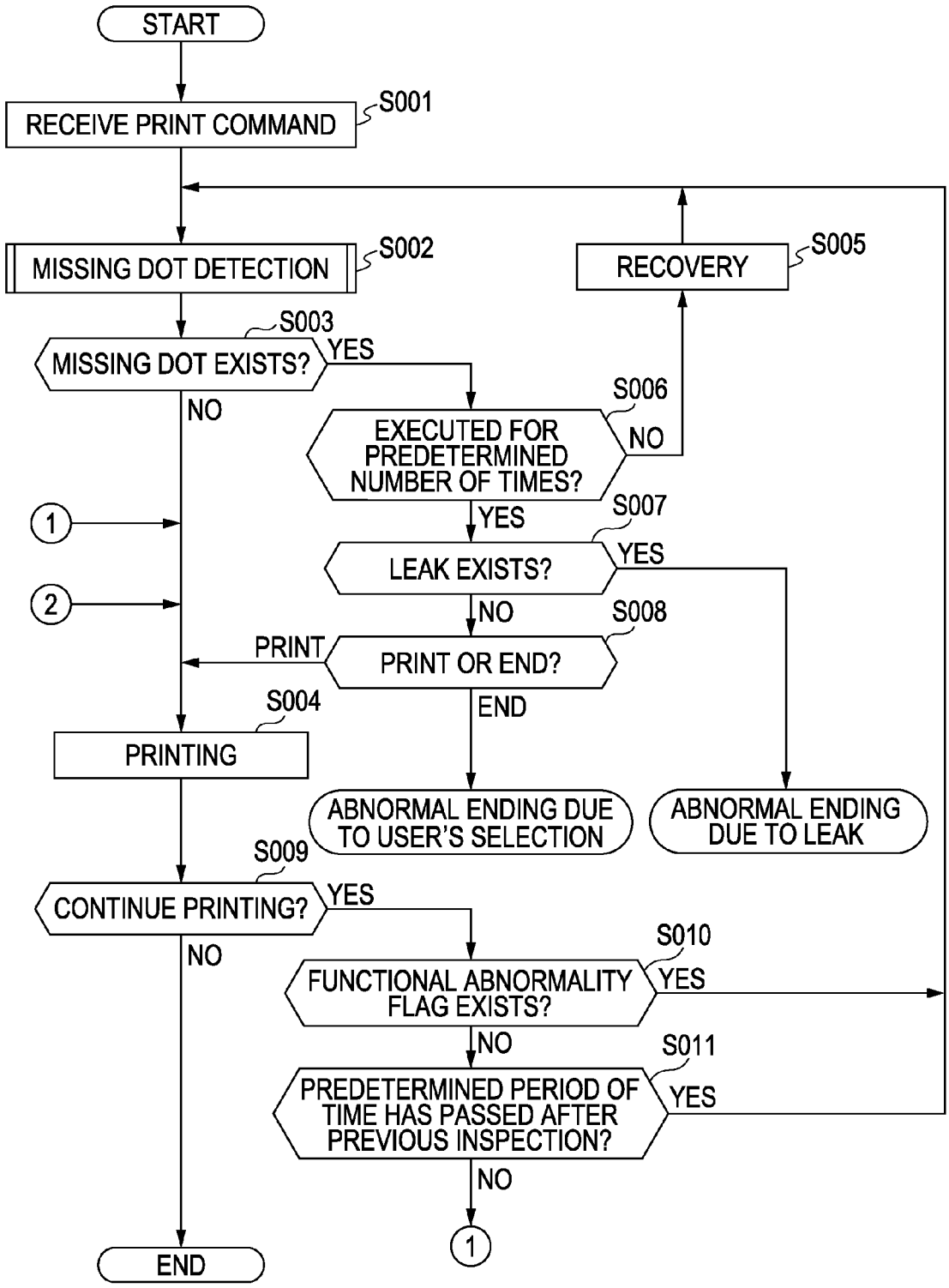
FIG. 11 is a flowchart illustrating printing of the printer.

FIG. 11 is a flowchart illustrating printing of the printer 1. The printing is controlled by the printer controller 80. First, when the printer controller 80 receives a print command (S001), the printer controller 80 executes "a missing dot detection" (S002). It is determined whether the dot missing nozzles exist by the missing dot detection (the details of which are described below). When no dot missing nozzle is detected (N in S003), the printing is executed (S004). Alternatively, when the dot missing nozzle is detected (Y in S003), the above-described recovery operation (for example, the pump sucking operation, the minute vibration operation, and the cleaning operation) is executed on the dot missing nozzle (S005).

After the recovery operation ends, the missing dot detection is executed again to check whether the ink droplets are normally ejected from the dot missing nozzle by the recovery operation. In this case, when the dot missing nozzle is detected even upon repeating the recovery operation a predetermined number of times, that is, when the missing dot detection is executed the predetermined number of times (Y in S006), it is determined whether current leaks from the detecting electrode 613 (S007, based on the storage in the resistor). When it is determined that the current leak from the detecting electrode 613 is not solved (Y in S007), it is considered that the current leak barely removed in the recovery operation exists. Therefore, due to current leak, the series of operations ends as abnormal ending. Alternatively, when no current leaks (N in S007), the user selects whether to permit the printing in the state where the dot missing nozzle exists or to forcibly terminate the printing without permitting the printing (S008). When the user selects the forcible termination, the printer controller 80 ends the series of operations as abnormal ending caused due to the user's selection. Alternatively, when the user selects the printing, the printing is executed (S004). When the printing is executed in the state where the dot missing nozzle exists, the print data may be complemented by enlarging the diameter of dots to be formed by the nozzles in the vicinity of the dot missing nozzle, for example.

When one-unit printing such as printing on one sheet or a series of operations corresponding to one job ends, the printer controller 80 checks whether data to be continuously printed exists (S009). When the data to be continuously printed exists (Y in S009), it is checked whether a functional abnormality flag (which is described below) exists (S010). When the functional abnormality flag is set in the resistor (corresponding to a memory) of the detection controller 57 (Y in S010), the missing dot detection is executed before the next printing is executed (S002). When the functional abnormality flag is not set in the resistor (N in S010) and when a predetermined period of time has not passed after the previous missing dot detection (N in S011), the next printing is executed. Alternatively, when the functional abnormality flag is not set in the resistor (N in S010) but the predetermined period of time has passed after the previous missing dot detection (Y in S011), the missing dot detection is executed (S002). Since the ink near the nozzles which are not frequently used thickens with time, the missing dot may occur. Therefore, the missing dot detection is executed at a predetermined time interval.

Missing Dot Detection

Figure 12:
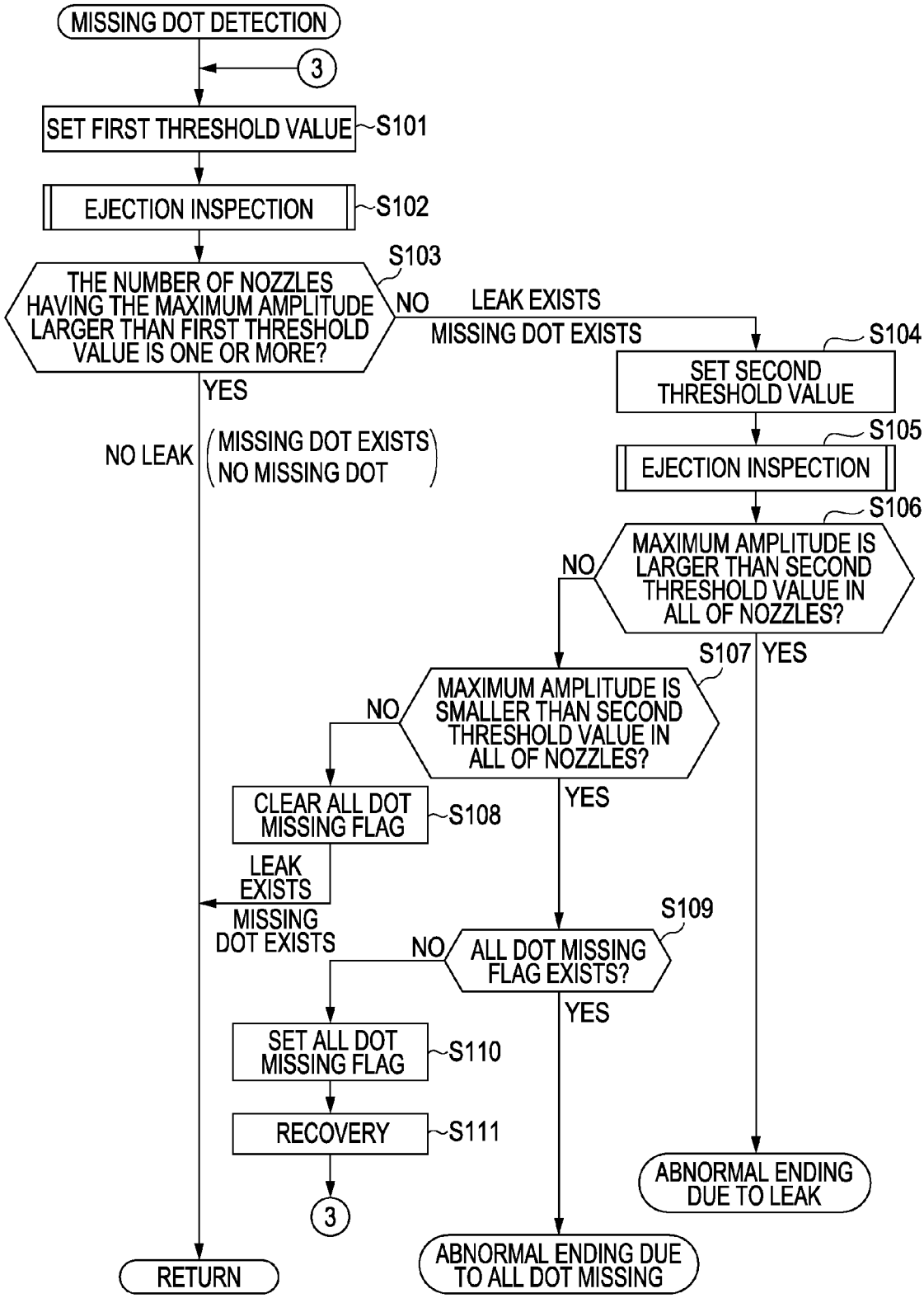
FIG. 12 is a flowchart illustrating the missing dot detection.

FIG. 12 is a flowchart illustrating the missing dot detection (S002 of FIG. 11). Next, the missing dot detection will be described. The missing dot detection is executed in a state where the carriage 21 is moved up to an inspection position, as shown in FIG. 3B. The detection controller 57 first sets the first threshold value TH1 (S101). As described above, the first threshold value TH1 is a threshold value used to determine whether the ink droplets are normally ejected (see FIG. 10). Subsequently, the ejection inspection for the nozzles Nz is executed (S102, the details of which are described below). When the ejection inspection for all the blocks normally ends, it is determined whether the maximum amplitude Vmax of the voltage signal SG corresponding to at least one nozzle is larger than the first threshold value (S103). When the maximum amplitude Vmax for one or more nozzles Nz is larger than the first threshold value TH1, "no leak" in which the abnormality (for example, current leak) occurs in the detecting electrode 613 is determined (Y in S103). In addition, when "leak existence" is stored in the resistor, "the leak existence" is corrected into "the no leak". When the process returns from the missing dot detection (see the flowchart of FIG. 11) and the maximum amplitude Vmax for all of the nozzles Nz is larger than the first threshold value TH1, the next predetermined process (the printing) of determining that no dot missing nozzle exists (N in S003 of FIG. 11) is executed.

Alternatively, when the maximum amplitude Vmax for all of the nozzles Nz is equal to or smaller than the first threshold value TH1 (N in S103), it is considered that an abnormality such as current leak caused through the detecting electrode 613 or short circuit occurs in a hardware device. In this case, the detection controller 57 sets the second threshold value TH2 (S104). As described above, the second threshold value TH2 is a threshold value used to determine whether the abnormality (an abnormality caused due to the current leak) occurs in the detecting electrode 613 due to a short circuit or the like (see FIG. 10). Subsequently, the ejection inspection is executed again (S105) and it is determined whether the maximum amplitude Vmax for all of the nozzles Nz is larger than the second threshold value TH2 (S106). When this condition is satisfied (Y in S106), it is considered that the abnormality such as the current leak caused through the detecting electrode 613 occurs. Therefore, the abnormal ending due to the current leak is executed. For example, a message indicating that an abnormality has occurred is displayed on a display by stopping the conductivity to the detecting electrode 613.

Alternatively, when this condition is not satisfied (N in S106), it is determined whether the maximum amplitude Vmax for all of the nozzles Nz is smaller than the second threshold value TH2 (S107). When this condition is satisfied (Y in S107), it is recognized that the ink droplets are not ejected from any of the nozzles Nz for control. Therefore, whether the same recognition is made in the previous ejection inspection is determined by whether "all the dot missing flags" are set in the resistor (S109). When all the dot missing flags are set (Y in S109), it is assumed that an abnormality occurs in the hardware (the printer 1) and that an abnormality (an abnormality caused since the ink droplets are not ejected from any of the nozzles Nz) occurs due to some of the dots being missing, and thus the series of operations ends. Alternatively, when all the dot missing flags are not set (N in S109), all of the dot missing flags are set in the resistor (S110) and the fact that "the leak exists and the missing dots exist" is stored in the resistor. Subsequently, the recovery operation is executed (S111) and the ejection inspection is executed again (S102). When the above-described processes are repeated in this manner to execute the recovery operation (S111) but the maximum amplitude Vmax for all of the nozzles Nz is smaller than the second threshold value TH2 (Y in S107), the abnormality ending is executed due to some of the dots being missing. When one or more nozzles having the maximum amplitude Vmax larger than the first threshold value exist (Y in S103) from the result of the ejection inspection (S102) obtained by executing the recovery operation (S111), it is considered that this state is not the state of "the missing of the entire dots". Therefore, when "all the dot missing flags" are set in the resistor, all the dot missing flags are cleared.

Alternatively, when the maximum amplitude Vmax for some of the nozzles Nz is equal to or larger than the second threshold value in S107 (N in S107), it is considered that the current leak occurs and the dot missing (the non-ejection of the ink droplets) occurs in the some of the nozzles Nz. In this case, all the dot missing flags are cleared (S108). Information on the existence of the missing dot and information on the existence of the current leak are set in the resistor and the process returns from the dot missing detection. Subsequently, it is determined that the missing dot exists in S003 of the flowchart of FIG. 11 and the recovery operation is thus executed (S005). When the current leak is not recovered even after the recovery operation, as described above, "the abnormal ending due to the current leak" is executed.

The reason that the abnormal ending is not instantly executed when the current leak exists and the missing dot exists (N in S107) will be described. That is because the ink or the foreign substance between the detecting electrode 613 and the nozzle surface is removed by the recovery operation and there is a possibility of removing the current leak. Even when an amount of ink ejected in the nozzles Nz is decreased, there is a possibility that the maximum amplitude Vmax of the voltage signal SG for each nozzle Nz is equal to or smaller than the first threshold value TH1 and equal to or larger than the second threshold value. In this case, it is difficult to distinguish from the case (N in S107) where the current leak exists and the missing dot exists in terms of the control. In this case, it is possible to distinguish from the case by executing the recovery operation (S005 of FIG. 11).

When the current leak exists but the missing dot does not exist (Y) in S106 of the flowchart of FIG. 12, the abnormal ending due to the current leak is instantly executed, but the recovery operation may be execute before that. When the current leak is not removed even after the recovery operation, the abnormal ending may be executed.

Ejection Inspection

Figure 13:
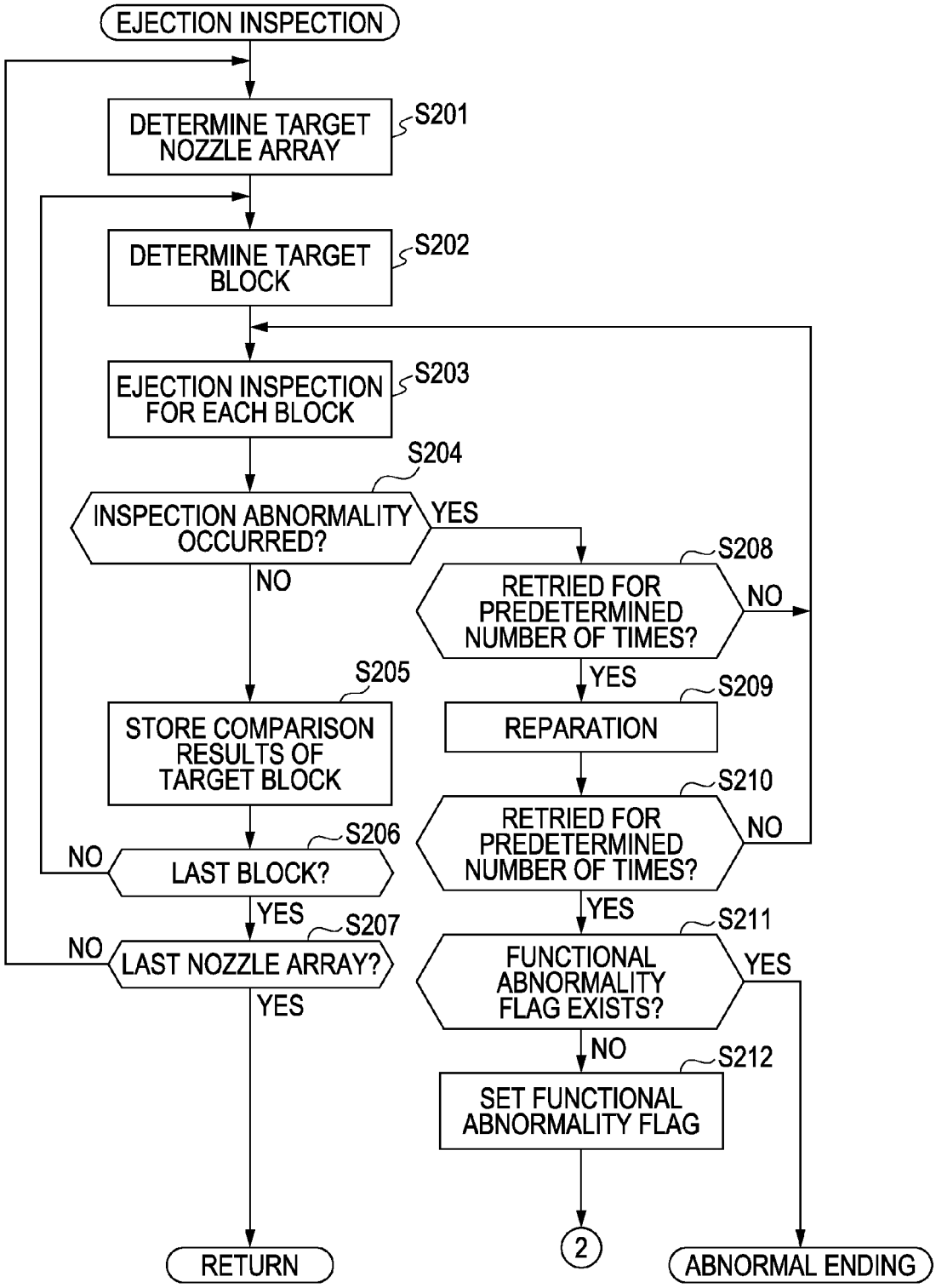
FIG. 13 is a flowchart illustrating ejection inspection.
Figure 14:
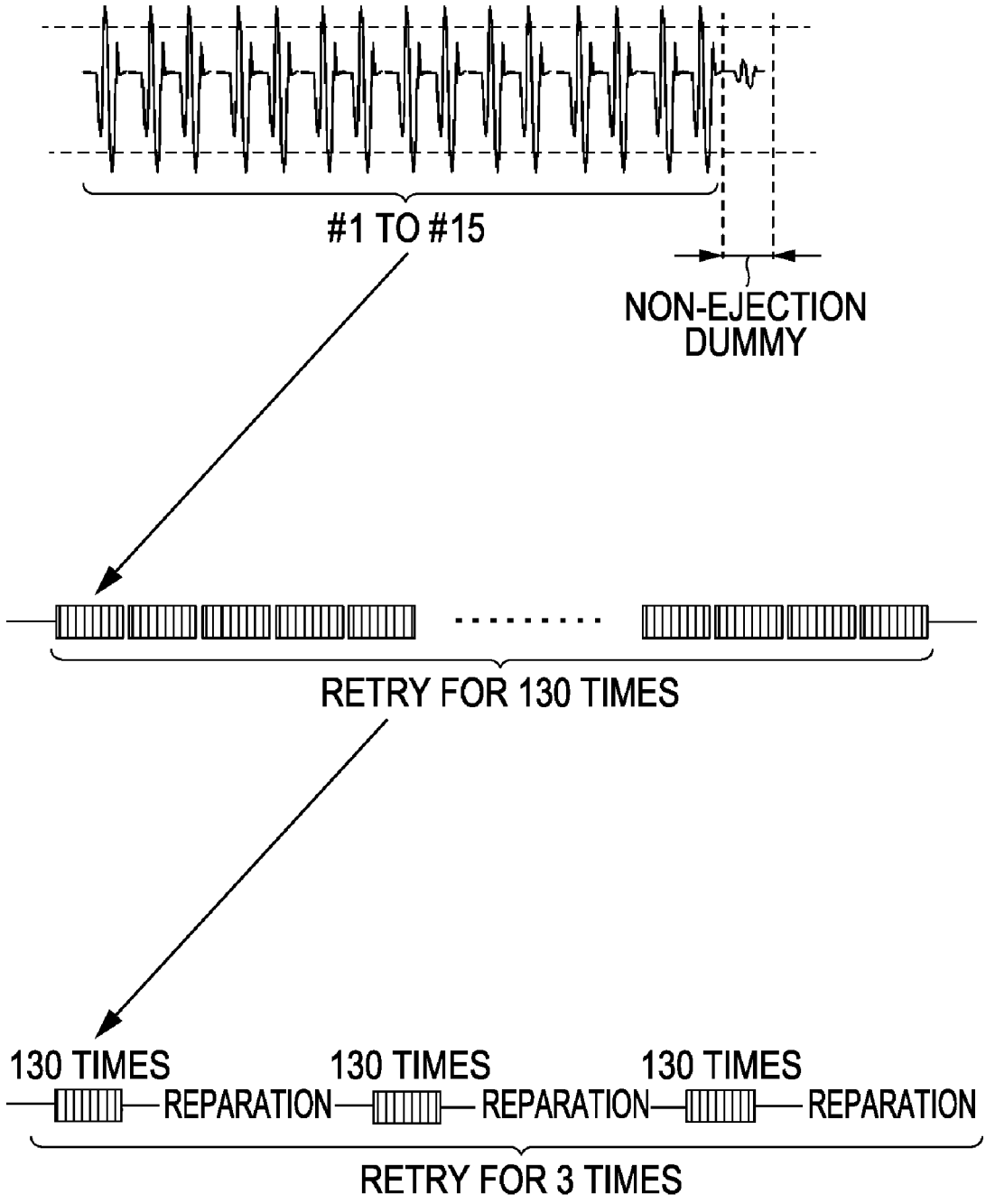
FIG. 14 is a diagram illustrating the ejection inspection.

FIG. 13 is a flowchart illustrating the ejection inspection. FIG. 14 is a diagram illustrating the ejection inspection. Next, the specific order of the ejection inspection (S102 and the like in FIG. 12 and corresponding to the ejection inspection) will be described. In the ejection inspection, a target nozzle array is determined among six nozzle arrays constituting the head 31 (S201). Subsequently, the target nozzle array is divided into twelve blocks (see FIG. 8) and a target block is determined among the blocks (S202).

Subsequently, the ejection inspection is executed on the nozzles Nz belonging to the target block (S203). Specifically, the ink droplets continue to be ejected twenty to thirty times from the nozzles Nz based on the driving signal COM shown in FIG. 6A. The detection controller 57 acquires the electric variation of the detecting electrode 613 caused due to the ejection of the ink droplets as the voltage signal SG shown in FIG. 6B. The detection controller 57 acquires the voltage signal SG and then the AD converter 57*b* of the detection controller 57 converts the voltage signal SG into a digital signal. The maximum amplitude Vmax as the inspection result of each nozzle Nz is calculated based on the digital signal. Subsequently, the voltage comparator 57*c* compares the maximum amplitude Vmax to the threshold value (the first threshold value TH1 or the second threshold value TH2) and stores the comparison results in the resistor of the detection controller 57. For example, when the resistor for the comparison results is one bit, the comparison results are stored as two kinds of contents such as "higher than the threshold value" and "equal to or smaller than the threshold value".

In addition to the comparison result obtained by comparing the maximum amplitude Vmax of each nozzle Nz to the threshold value, the maximum amplitude Vmax (the maximum value of the voltage variation) in the non-ejection dummy period is also compared to the threshold value (the first threshold value TH1). When the maximum amplitude Vmax in the non-ejection dummy period is smaller than the threshold value, it is determined that no noise has occurred in the inspection period of the previous target block (N in S204). In this case, the comparison results of the target block are stored in the resistor (S205). In addition, when the target block is the final block (Y in S207), the next nozzle array is the inspection target. Alternatively, when the target block is not the final block (N in S207), the next block becomes the inspection target. Likewise, when the target nozzle array is the final nozzle array (Y in S207), the process returns from the ejection inspection. Alternatively, when the target nozzle array is not the final nozzle array (N in S207), the next nozzle array becomes the inspection target.

Alternatively, when the maximum amplitude Vmax in the non-ejection dummy period is larger than the threshold value, it can be determined that the noise has occurred in the inspection period of the previous target block. Therefore, it is determined that an inspection abnormality has occurred (Y in S204). Therefore, the comparison results of the previous target block are nullified. In this way, when the inspection abnormality occurs, the ejection inspection (S203 and S204) is repeatedly executed up to a predetermined number of times (here, 130 times) until the ejection inspection is normally executed on the target block (N in S208).

When the ejection inspection is repeatedly executed on the target block in S208 up to the predetermined number of times (here, 130 times) but the inspection abnormality occurs (Y in S208), reparation is executed (S209). For example, movement of the carriage 21 is an example of the reparation. The reparation is an operation of temporarily moving the carriage 21 from the inspection position (for example, the position of FIG. 3B) to the print area (the left side in the movement direction) and then returning the carriage 21 to the inspection position. By executing this operation, the abnormality occurring due to a mechanical cause is removed in some cases. For example, the short circuit caused between the detecting electrode 613 and the nozzle plate 33*b* due to the ink or the foreign substance attached to the wiper 66 is removed in some cases.

After the reparation, the ejection inspection on the target block is repeatedly executed a predetermined number of times (thirteen times) until the ejection inspection is normally executed. Moreover, the reparation is also repeatedly executed a predetermined number of times (here, three times). That is, in this embodiment, the ejection inspection is executed on one target block up to the maximum 390 (=130 times×3 times) in one-time ejection inspection. Even when the ejection inspection is not normally executed even in this case (Y in S210), it is checked as to whether the functional abnormality flag is set in the resistor (S211). In addition, the ejection inspection may be repeatedly executed in each block without executing the reparation.

When the functional abnormality flag is not set in the resistor (N in S211), the functional abnormality flag is set in the resistor (S212, information on the abnormality of the ejection inspection is stored in a memory), the process returns from the ejection inspection. In this case, the ejection inspection is not executed on the block after the target block (S004 of FIG. 11 and corresponding to the next predetermined operation). Alternatively, when the functional abnormality flag is already set (Y in S211), it is determined that the abnormality has occurred in the printer 1 and thus a series of operations ends.

Timing of Ejection Inspection

In this embodiment, the detection controller 57 acquires the electric variation, which is caused in the detecting electrode 613 by the ejection of the ink droplet from the nozzles Nz, as the voltage signal SG (see FIG. 6B) and detects the dot missing nozzle based on the voltage signal SG. When a noise occurs in the voltage signal SG, as in FIG. 7B, the dot missing nozzle may not be exactly detected. Therefore, the ejection inspection is executed in every block constituted by the plural nozzles Nz and the non-ejection dummy period is provided during the ejection inspection of every block. The maximum amplitude Vmax in the non-ejection dummy period is compared to the threshold value to determine whether the noise occurs in the inspection period. When the maximum amplitude Vmax in the non-ejection period is larger than the threshold value, as in FIG. 7B, it is determined that the noise has occurred in the inspection period. Then, the inspection result of the previous block in the non-ejection dummy period is nullified.

The ejection inspection is controlled by the printer controller 80 (corresponding to a controller). As for the ejection inspection, when it is determined that the noise has occurred in the ejection inspection period of every block (Y in S204 of FIG. 13), the ejection inspection is repeatedly executed on one target block up to the maximum 390 times until the ejection inspection is normally executed. The maximum number of times that the ejection inspection is repeatedly executed on one target block may be determined based on the allowed time or the like for keeping the nozzle surface (meniscus) moist, for example.

In the noise occurring in the voltage SG, there are a noise which occurs for a long period of time and a noise which occurs for a short period of time. Moreover, there is a noise which is not removed even though the above-described reparation is executed. When the ejection inspection of a certain target block is executed, it is known in the next non-ejection dummy period that the noise has occurred in the inspection period. Here, when the noise has occurred in the non-ejection dummy period in the one-time ejection inspection, the abnormal ending is instantly executed or the next predetermined operation (for example, printing) is executed without executing the ejection inspection on the target block or another block. Then, when the noise which has occurred in the ejection inspection period of the target block is a short-term noise and the ejection inspection is executed again, for example, the ejection inspection ends even in spite of the fact that no noise has occurred in the ejection inspection. In this way, when the ejection inspection instantly ends in the case where the noise has occurred in the one-time ejection inspection, the ejection inspection cannot be appropriately executed. As a consequence, an image may be printed in the state where the dot missing nozzles exist or the user unnecessarily has to make an effort to handle a matter of the printer 1 later.

In order to solve this problem, in this embodiment, when the noise has occurred in the ejection inspection of a certain target block in the one-time ejection inspection (see FIG. 13) and an abnormality has occurred in the ejection inspection, the ejection inspection is repeatedly executed up to the predetermined number of times (here, 390 times) until the ejection inspection of the certain target block is normally executed. In this way, when the noise is the short-term noise, the noise is removed while the ejection inspection is repeatedly executed up to the predetermined number of times. Therefore, the ejection inspection can be normally executed.

Here, in the one-time ejection inspection (see FIG. 13), the number of times that the ejection inspection of a certain target block is repeatedly executed may not be limited. That is, even when the ejection inspection is executed a number of times more than the predetermined number of times (390 times) until the ejection inspection is normally executed, the ejection inspection is repeatedly executed. In this case, when the noise which has occurred in the ejection inspection of the target block is a long-term noise, for example, the ejection inspection is unnecessarily repeated over a long period in which the noise has occurred. Therefore, since it takes a long time to execute the ejection inspection, the time necessary to execute the printing becomes unnecessarily longer. Moreover, since the ejection inspection is repeated, the ink is unnecessarily consumed. Furthermore, since the nozzle surface is dried in the ejection inspection period, the missing dot may occur.

In this embodiment, when the ejection inspection is repeatedly executed up to the predetermined number of times (here, 390 times) in the one-time ejection inspection (see FIG. 13) but the ejection inspection is not normally executed (Y in S210 of FIG. 13), the ejection inspection is temporarily stopped. Subsequently, it is checked as to whether the functional abnormality flag is set in the resistor (S211). When the functional abnormality flag is not set (N in S211), the functional abnormality flag is set in the resistor and then the next predetermined operation (the printing of S004 of FIG. 11) is executed. When the printing continues after the end of the next printing (Y in S009), it is checked again whether the functional abnormality flag is set (Y in S010) and then the ejection inspection (the missing dot detecting operation) is executed again.

When the ejection inspection is repeatedly executed up to the predetermined number of times (390 times) in the retried ejection inspection (see FIG. 13) after the printing but the ejection inspection is not normally executed, it is checked whether the functional abnormality flag is set in the resistor (Y in S211), it is considered that the abnormality has occurred in the printer 1, and thus the series of operations ends. When the ejection inspection is normally executed in the ejection inspection after the functional abnormality flag is set, the functional abnormality flat may be cleared (not shown).

In this way, even when the ejection inspection is repeatedly executed up to the predetermined number of times in a first ejection inspection due to the occurrence of the long-term noise but the ejection inspection cannot be normally executed, the long-term noise is removed during the subsequent printing in some cases. Then, the ejection inspection can normally be executed in a second ejection inspection. In addition, when the ejection inspection is repeatedly executed up to the predetermined number of times but the ejection inspection cannot be normally executed, the inspection abnormality is removed in some cases in the ejection inspection after the printing. That is because various processes such as the movement of the carriage 21, the transportation of sheets, and the ejection of the ink droplets from the nozzles are executed in the printing and thus the status of the printer 1 is varied.

That is, when the ejection inspection is repeatedly executed up to the predetermined number of times but the ejection inspection cannot be normally executed, the next predetermined operation (for example, the printing) is executed. Then, since the time of the ejection inspection can be delayed, there is a high possibility that the ejection inspection is executed at the time when no noise occurs. In addition, since the status (for example, the status of the nozzle surface and the capping mechanism 60) of the printer 1 is varied by executing the next predetermined operation, the occurrence cause of the noise is removed and thus there is a high possibility that the ejection inspection is normally executed in the ejection inspection after the next predetermined operation.

When the ejection inspection cannot be normally executed even in the retried ejection inspection after the next predetermined operation, it is considered that a certain abnormality occurs. For example, when the printer 1 is installed at an inappropriate place and the noise occurs due to the continuous vibration of the printer 1, the noise is not removed even after the execution of the next predetermined operation (the printing) as long as the printer 1 is installed at another place. For this reason, when the ejection inspection after the next predetermined operation cannot be normally executed (when the functional abnormality flag is set), it is considered that the abnormality occurs in the printer 1 and then a series of operations ends.

In summary, in this embodiment, the ejection inspection is repeatedly executed up to the predetermined number of times until the ejection inspection is normally executed. Even in this case, when the ejection inspection is not normally executed, the functional abnormality flag is set to execute the next predetermined operation. In addition, when the ejection inspection is repeatedly executed up to the predetermined number of times again after the next predetermined operation but the ejection inspection cannot be normally executed, it is determined that an abnormality occurs in the printer 1. In this way, since the various noises such as the long-term noise or the short-term noise are removed to execute the ejection inspection, the ejection inspection can be appropriately executed. Moreover, since the unnecessary ejection inspection can be prevented from being repeatedly executed, it is possible to prevent the inspection period from becoming longer and it is possible to reduce the amount of ink consumed.

In this embodiment, the missing dot detecting operation (the ejection inspection) is executed when the print command is received (S001 of FIG. 11) or after the recovery operation for the dot missing nozzle is executed (S005 of FIG. 11). However, the invention is not limited thereto. For example, when the printer 1 is turned on, the missing dot detecting operation (the ejection inspection) may be executed. After the printer 1 is turned on, in many cases the user sets sheets in the printer 1. As described above, an action of the user setting sheets in the printer 1 is an example of a main cause of the noise occurring in the voltage signal SG. Therefore, the ejection inspection cannot be normally executed, even when the ejection inspection (the missing dot detecting operation) is repeatedly executed immediately after the printer 1 is turned on. Then, after executing the next predetermined operation (for example, a standby operation), it can be checked that the sheets are set in the printer 1 before retrying of the ejection inspection.

In the flowcharts of FIGS. 11 and 13, when the ejection inspection is repeatedly executed up to the predetermined number of times but the ejection inspection cannot be normally executed (see FIG. 13), the functional abnormality flag is set (S212 of FIG. 13) and then the printing is executed (S004 of FIG. 11). However, the invention is not limited thereto. "The next predetermined operation" after the functional abnormality flag is set may be the standby operation or the recovery operation. In this way, the time of executing the ejection inspection can be delayed. When the flushing operation is executed in the recovery operation, for example, the foreign substance attached to the nozzle surface can be removed. Therefore, it is possible to remove the noise occurring since the current leaks from the detecting electrode 613 through the foreign substance. As "the next predetermined operation", the carriage 21 is moved or the carriage 21 may be moved in the state where the state of FIG. 3B is stored. As a consequence, the nozzle surface (the nozzles) does not face the detecting electrode 613. In this way, since the noise occurring due to the current leak through the ink or foreign substances between the nozzle surface and the detecting electrode 613 can be removed, the possibility of normally executing the ejection inspection after the predetermined operation becomes high. In particular, when the carriage 21 is moved in the state where the state of FIG. 3B is stored, the substances attached to the nozzle surface can be removed by the wiper 66. Therefore, it is easy to remove the noise.

After the functional abnormality flag is set, the recovery operation may be executed before the execution of the printing operation (S004 of FIG. 11). In this way, when the printing is executed in the state where the ejection inspection for all of the nozzles is not normally executed, that is, even when it is not known whether the dot missing nozzle exists, the dot missing nozzle is recovered by the recovery operation before the printing. Therefore, it is possible to prevent the quality of a print image from deteriorating.

In the flowchart of FIG. 11, when the next printing continues (Y in S009) after the execution of the printing (S004), the missing dot detecting operation is immediately executed in the case where the functional abnormality flag is set (Y in S010). However, the invention is not limited thereto. For example, when the functional abnormality flag is not set, the missing dot detecting operation may be executed after a predetermined time (for example, 1 hour). Alternatively, when the functional abnormality flag is set, the missing dot detecting operation may be executed after the time (for example, 30 minutes) shorter than the predetermined time. That is, when the functional abnormality flag is set, the ejection inspection for all of the nozzles is not normally executed in the previous missing dot detecting operation. Therefore, when the dot missing nozzle exists, an image may deteriorate. Accordingly, in a case where the functional abnormality flag is set, a period of time taken from the previous missing dot detecting operation (the ejection inspection) to the next missing dot detecting operation (the ejection inspection) is shorter than the period of time of the case where the functional abnormality flag is not set. In this way, it is possible to prevent an image from deteriorating since the ejection inspection cannot be normally executed.

Other Embodiments

In the above-described embodiment, the printing system including the ink jet printer has mainly been described, but the disclosure of an ejection detecting method is also included. The above-described embodiment has been described for easily understanding of the invention and the invention is not considered as limited by the embodiment. The invention may be modified and improved without departing from the gist of the invention and the equivalents of the invention are of course included in the invention. In particular, the following embodiments are included in the invention.

Non-Ejection Dummy Period

In the above-described embodiment, the non-ejection dummy period is provided between the ejection inspection periods (the ejection inspection of every block) of the nozzles in order to check whether the noise occurs in the voltage signal SG acquired from the detecting electrode 613. In order to exactly check whether the noise occurs, it may be checked whether the noise occurs based on the frequency, for example, of the voltage signal SG. For example, when a signal having a frequency higher than the frequency of the voltage signal SG to be originally acquired is obtained in an ejection period corresponding to one nozzle, it can be determined that the noise has occurred.

In the above-described embodiment, the number of nozzles belonging to the block is determined based on the result (the nozzle number determination test in FIG. 9C) obtained in the manufacturing process by varying the number of nozzles belonging to the unit block plural times and executing the ejection inspection. In addition, the non-ejection dummy period is provided at the interval of the ejection inspection for the fifteen nozzles. However, the invention is not limited thereto. For example, the designer may determine an appropriate number of nozzles without executing the nozzle number determination test.

Printing

In the above-described embodiment, the printing is executed in accordance with the flowcharts shown in FIGS. 11 to 13, but the invention is not limited thereto. For example, the reparation shown in S209 of FIG. 13 may be not be provided, the ejection inspection may not be repeatedly executed up to the predetermined number of times, or the abnormal ending may be executed when it is determined that the ejection inspection is not normally executed in one-time ejection inspection.

Missing Dot Detecting Section 50

In the above-described embodiment, the abnormality in the detecting electrode 613 has been detected based on the variation in the electric state caused by the ejection inspection current If without providing the voltage dividing circuit in the missing dot detecting section 50. However, the invention is not limited thereto. For example, by allowing the voltage dividing circuit to divide the power supply voltage, the abnormality in the detecting electrode 613 may be detected based on the detected voltage. Then, it is not necessary to set the second threshold value.

In the above-described embodiment, in the detecting electrode 613 with a high voltage and the nozzle plate 33*b* with the grand potential, it is detected whether the dot missing nozzle exists based on the electric variation in the detecting electrode 613 caused due to the ejection of the ink droplets from the nozzles. However, the invention is not limited thereto. When it is detected whether the dot missing nozzle exists based on the electric variation as in the above-described embodiment, there is a case where the influence of the noise cannot be exactly inspected. Therefore, the invention is effective.

Figure 15A:
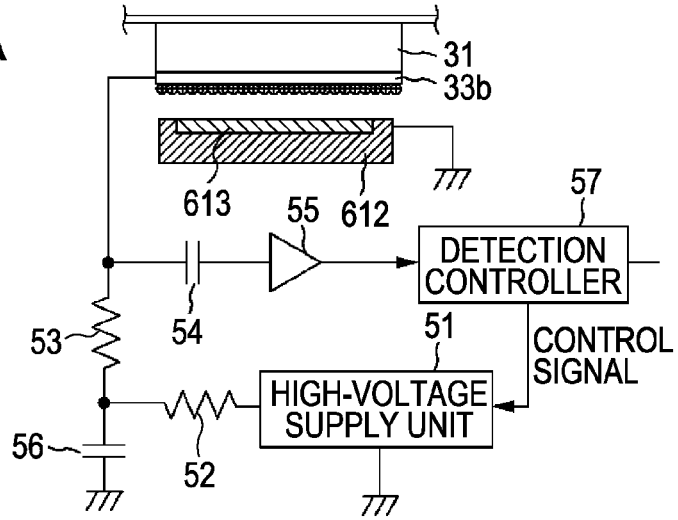
FIGS. 15A to 15C are diagrams illustrating the other configurations of the dot missing nozzle.
Figure 15B:
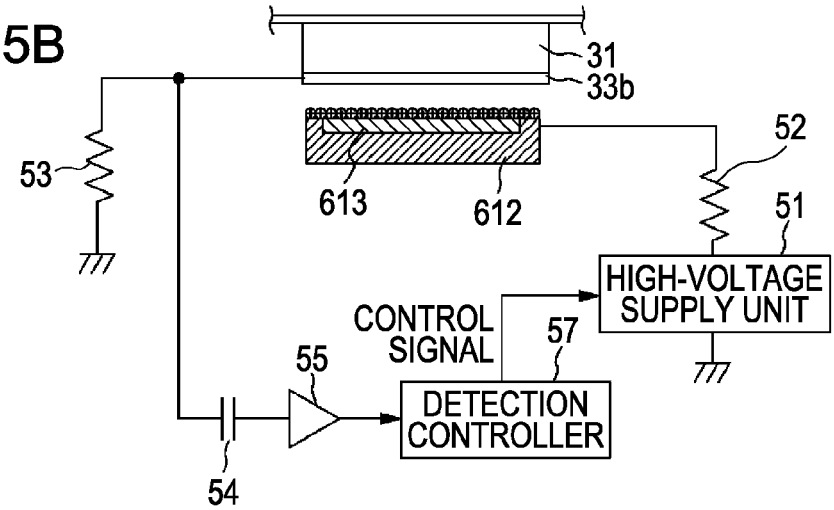
Figure 15C:
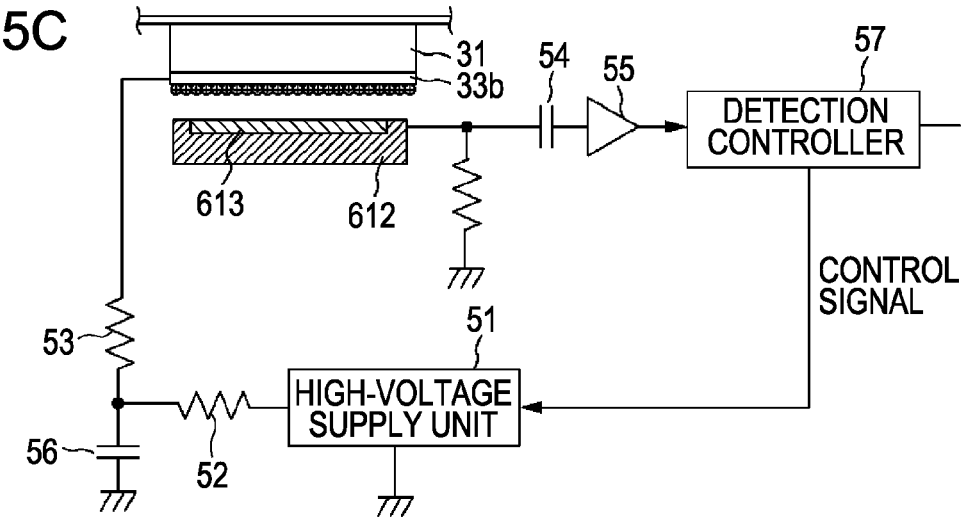

In the above-described embodiment, as shown in FIG. 5A, the detecting electrode has a voltage higher than that of the nozzle surface and the variation in the potential of the detecting electrode 613 caused due to the ejection of the ink droplets is extracted by the detecting capacitor 54. However, the invention is not limited thereto. FIGS. 15A to 15C are diagrams illustrating the other configurations of the dot missing nozzle. In FIG. 15A, the high-voltage supply unit 51 is connected to the nozzle plate 33*b* (corresponding to the first electrode) so that the nozzle plate 33*b* is charged with a high voltage (corresponding to the first potential). In addition, the detecting electrode 613 (corresponding to the second electrode) is connected to the grand line so as to be charged with the grand potential (corresponding to the second potential). Then, the dot missing nozzle is detected by the variation in the potential of the nozzle plate caused due to the ejection of the ink. In FIG. 15B, the detecting electrode 613 is charged with the high voltage and the nozzle plate 33*b* is charged with the grand potential to detect the dot missing nozzle by the use of the variation in the potential of the nozzle plate caused due to the ejection of the ink. In FIG. 15C, the detecting electrode 613 is charged with the grand potential and the nozzle plate 33*b* is charged with the high voltage to detect the dot missing nozzle by the use of the variation in the potential of the detecting electrode 613 caused due to the ejection of the ink.

In the above-described embodiment, the ink to be ejected from the nozzles is charged with the grand potential by charging the nozzle plate with the first potential (the grand potential). However, the invention is not limited thereto. The nozzle plate may not be used as the electrode, when the ink to be ejected from the nozzles is charged with the first potential (the grand potential). For example, by providing a conductive member in the ink passage or the wall surface of the pressure chamber 331 to be conductive to the ink in the nozzle Nz, the conductive member may be charged with the grand potential. In addition, the ink is not limited to the grand potential. A potential difference necessary for the detection along with the detecting electrode 613 may be provided.

Abnormality in Ejection Inspection

In the above-described embodiment, in the ejection inspection, when the ejection inspection is repeatedly executed up to the predetermined number of times on a certain block but the ejection inspection cannot be normally executed, the same operation (the printing in FIG. 11) is executed even upon normal ending of the ejection inspection. However, the invention is not limited thereto, but another operation may be executed.

Line Printer

In the above-described embodiment, the printer 1, which alternately performs an image forming operation of ejecting the ink droplets while the head 31 moves in the movement direction and the transport operation of relatively moving the medium with respect to the head 31 in the transport direction interesting the movement direction, has been described. However, the invention is not limited thereto. For example, there may be provided a line head printer which forms an image by arranging a head (nozzles) in a sheet surface direction intersecting a transport direction of a medium and by ejecting ink droplets toward the medium transported below the head.

Liquid Ejecting Apparatus

In the above-described embodiment, the ink jet printer is exemplified as (a part of) a liquid ejecting apparatus for realizing the liquid ejecting method, but the invention is not limited thereto. Various industrial apparatuses are applicable as the liquid ejecting apparatus other than the printer (the printing apparatus). For example, the invention is applicable to a printing apparatus for attaching a pattern to a cloth, a display manufacturing apparatus such as a color filter manufacturing apparatus or an organic EL display, a DNA chip manufacturing apparatus for manufacturing a DNA chip by applying a solution liquefied with DNA to a chip, or the like.

The liquid ejecting method may be a piezoelectric method of applying a voltage to a driving element (an piezoelectric element) and ejecting a liquid by expansion and contraction of an ink chamber or a thermal method of generating bubbles in nozzles by the use of a heating element and ejecting a liquid by the bubbles.

What is claimed is:

1. A liquid ejecting apparatus comprising:

a head which ejects a liquid from nozzles, each nozzle belonging to one of a plurality of blocks;

a first electrode which charges the liquid with a first potential;

a second electrode which is charged with a second potential different from the first potential; and an inspector which inspects whether the liquid is ejected from the nozzles in every block based on a variation in a potential caused in at least one of the first and second electrodes by ejecting the liquid charged with the first potential from the nozzles to the second electrode and which determines whether the inspection of liquid ejection from the nozzles is normally executed based on the variation in the potential during a non-ejection period of every block in which the liquid is not ejected from all of the nozzles of that block.

2. The liquid ejecting apparatus according to claim 1, wherein a plurality of the nozzles belongs to each block.

3. The liquid ejecting apparatus according to claim 1, wherein when the variation in the potential exceeds a threshold value in the non-ejection period provided in a certain block, the inspector determines that the inspection of the certain block is not normally executed.

4. The liquid ejecting apparatus according to claim 1, wherein the inspector executes the inspection of a certain block again, when the inspector determines that the inspection of the certain block is not normally executed.

5. The liquid ejecting apparatus according to claim 4, wherein when the inspection of the certain block is executed up to the predetermined number of times but the inspection of the certain block is not normally executed, the inspector allows the liquid ejecting apparatus to execute a predetermined operation and executes the inspection again after the predetermined operation.

6. The liquid ejecting apparatus according to claim 1, wherein a period in which it is inspected whether the liquid is ejected from one of the nozzles is the same as the non-ejection period.

7. An ejection inspecting method for inspecting whether a liquid is ejected from nozzles, each nozzle belonging to one of a plurality of blocks, the method comprising:

charging the liquid with a first potential by a first electrode;

ejecting the liquid charged with the first potential from the nozzles to a second electrode charged with a second potential different from the first potential;

inspecting whether the liquid is ejected from the nozzles in every block based on a variation in a potential caused in at least one of the first and the second electrodes; and determining whether the inspection of liquid ejection from the nozzles is normally executed based on the variation in the potential during a non-ejection period of each block in which the liquid is not ejected from all of the nozzles of that block.

* * * * *